US012790557B2

(12) United States Patent
Harvey et al.

(10) Patent No.: US 12,790,557 B2
(45) Date of Patent: Nov. 10, 2026

(54) CYCLOOCTANE CONTAINING FUEL COMPOSITIONS

(71) Applicants: The United States of America, as represented by the Secretary of the Navy, Arlington, VA (US); CleanJoule, Inc., Salt Lake City, UT (US)

(72) Inventors: Benjamin G. Harvey, China Lake, CA (US); Christopher Walkling, China Lake, CA (US); Mukund Karanjikar, Salt Lake City, UT (US); Robert Andrew Price, Salt Lake City, UT (US); Oyvind Hatlevik, Holladay, UT (US); Michael James Mella, South Jordan, UT (US)

(73) Assignees: The United States of America, as represented by the Secretary of the Navy, Arlington, VA (US); CycloKinetics, Inc., Salt Lake City, UT (US)

( * ) Notice: Subject to any disclaimer, the term of this patent is extended or adjusted under 35 U.S.C. 154(b) by 0 days.

(21) Appl. No.: 19/313,428

(22) Filed: Aug. 28, 2025

(65) Prior Publication Data

US 2026/0062631 A1 Mar. 5, 2026

Related U.S. Application Data

(60) Provisional application No. 63/687,830, filed on Aug. 28, 2024.

(51) Int. Cl.
*C10L 1/08* (2006.01)

(52) U.S. Cl.
CPC ..... *C10L 1/08* (2013.01)

(58) Field of Classification Search
CPC .. C10L 1/08; C10L 2270/04; C10L 2270/026; C10L 1/04
See application file for complete search history.

(56) References Cited

U.S. PATENT DOCUMENTS 5,906,662 A 5/1999 McCombes
2011/0005190 A1* 1/2011 Bauldreay ..... C10L 10/00 208/15

(Continued)

FOREIGN PATENT DOCUMENTS

IN MAS-1997-01320 A 6/2006

OTHER PUBLICATIONS

Caton et al., Understanding Ignition Delay Effects with Pure Component Fuels in a Single-Cylinder Diesel Engine, Mar. 2011, Journal of Engineering for Gas Turbines and Power, vol. 133, pp. 032803-1 through 032803-11 (Year: 2011).*

(Continued)

*Primary Examiner* — Cephia D Toomer
(74) *Attorney, Agent, or Firm* — CALDWELL LLC

(57) ABSTRACT

A method includes blending at least one n-alkane, at least one iso-alkane or a mixture thereof, and one or more compounds according to formula (I), wherein each R independently represents a hydrogen atom or an alkyl group, to provide a composition exhibiting a density greater than 0.775 g/mL and a derived cetane number greater than 30; wherein comprises between about 50% to about 95% by weight of the one or more compounds according to formula (I) and between about 5% to about 50% by weight of the mixture of the at least one n-alkane and the at least one iso-alkane.

20 Claims, 6 Drawing Sheets

(56) References Cited

U.S. PATENT DOCUMENTS

| | | | | |
|---|---|---|---|---|
| 2012/0110900 | A1* | 5/2012 | Tsai | C10L 1/1855 585/14 |
| 2014/0209224 | A1 | 7/2014 | Dobbins et al. | |
| 2015/0259619 | A1 | 9/2015 | Albuzat et al. | |
| 2018/0051222 | A1* | 2/2018 | D'Acosta | C10L 10/10 |
| 2019/0106644 | A1 | 4/2019 | Albuzat et al. | |
| 2021/0317376 | A1* | 10/2021 | Barrientos Betancourt | C10L 1/1852 |

OTHER PUBLICATIONS

Yang et al, Maximizing Sustainable aviation fuel usuage through optimization of distillation cut points and blending, 2023, Fuel, vol. 353, 129136 (Year: 2023).*

PCT/US2025/044050; International Search Report; By: Authorized Officer Harry Kim; Date: Dec. 8, 2025.

* cited by examiner (1*s*,4*s*)-1-isopropyl-4-methylcyclohexane (1*S*,3*R*)-1-isopropyl-3-methylcyclohexane (1*s*,4*s*)-1-ethyl-1,4-dimethylcyclohexane (1*S*,3*S*)-1-isopropyl-3-methylcyclohexane (1*r*,4*r*)-1-ethyl-1,4-dimethylcyclohexane (1*R*,3*S*)-1-ethyl-1,3-dimethylcyclohexane (1*r*,4*r*)-1-isopropyl-4-methylcyclohexane (1*R*,3*R*)-1-ethyl-1,3-dimethylcyclohexane

CYCLOOCTANE CONTAINING FUEL COMPOSITIONS

CROSS-REFERENCE TO RELATED APPLICATIONS

This application claims the benefit of priority of U.S. Provisional Patent Application Ser. No. 63/687,830, filed on Aug. 28, 2024, and titled "CYCLOOCTANE CONTAINING FUEL COMPOSITIONS," which is incorporated by reference herein in its entirety.

FIELD OF THE INVENTION

The present invention generally relates to the field of fuel compositions. In particular, the present invention is directed to cyclooctane containing fuel composition.

BACKGROUND

Petroleum based compounds are commonly used in a variety of fuel compositions, including those satisfying relevant standards for aviation fuels. In the aviation space for example, attempts to lower greenhouse gas emissions and increase efficiency, amongst other things, have resulted in several compositions including synthetic hydrocarbons which may be added to traditional jet fuel. However, the remaining composition still relies on the presence of petroleum based or derived compounds and therefore cannot be produced from a sustainable source. In addition, aromatic compounds which may not burn well and in turn result in increased pollution, particulate matter and wear on an engine, may be included in these compositions in order to provide them with the parameters required by relevant standards for aviation fuels, such as ASTM D7566.

SUMMARY OF THE DISCLOSURE

In one aspect, a composition includes at least one n-alkane, at least one iso-alkane or a mixture thereof, one or more compounds according to formula (I)

(I)

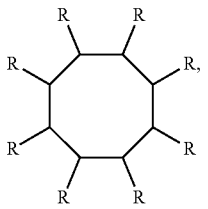

where each R independently represents a hydrogen atom or an alkyl group, a density greater than 0.775 g/mL, and a derived cetane number greater than 30; wherein comprises between about 50% to about 95% by weight of the one or more compounds according to formula (I) and between about 5% to about 50% by weight of the mixture of the at least one n-alkane and the at least one iso-alkane.

In another aspect, a method includes blending at least one n-alkane, at least one iso-alkane or a mixture thereof, and one or more compounds according to formula (I)

(I)

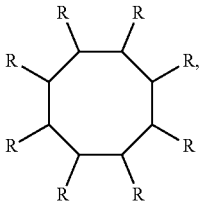

wherein each R independently represents a hydrogen atom or an alkyl group, to provide a composition exhibiting a density greater than 0.775 g/mL and a derived cetane number greater than 30; wherein comprises between about 50% to about 95% by weight of the one or more compounds according to formula (I) and between about 5% to about 50% by weight of the mixture of the at least one n-alkane and the at least one iso-alkane.

These and other aspects and features of non-limiting embodiments of the present invention will become apparent to those skilled in the art upon review of the following description of specific non-limiting embodiments of the invention in conjunction with the accompanying drawings.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

Figure 1:
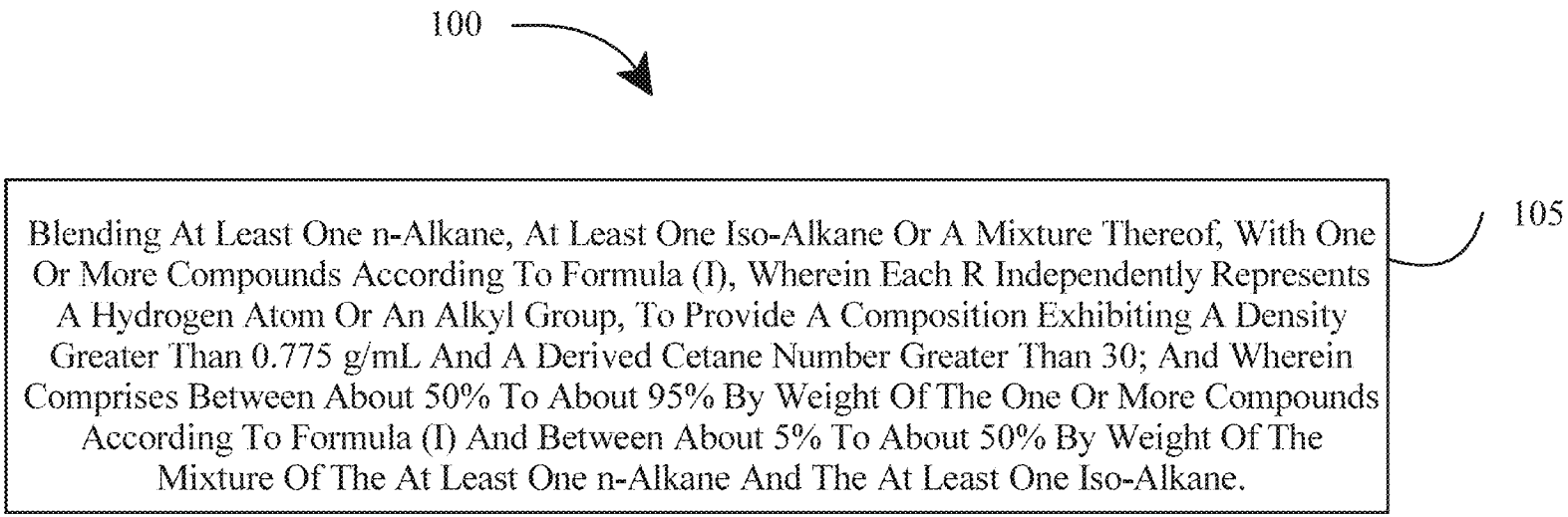
FIG. 1 is a flow diagram of an exemplary method making cyclooctane containing fuel composition.

The drawings are not necessarily to scale and may be illustrated by phantom lines, diagrammatic representations, and fragmentary views. In certain instances, details that are not necessary for an understanding of the embodiments or that render other details difficult to perceive may have been omitted. Like reference symbols in the various drawings indicate like elements.

DETAILED DESCRIPTION

Reference will now be made to the drawings to describe various aspects of example embodiments of the invention. It is to be understood that the drawings are diagrammatic and schematic representations of such example embodiments, and are not limiting the present invention, nor are they necessarily drawn to scale.

The present disclosure generally relates to fuel compositions. In particular, some embodiments relate to fuel compositions including one or more cyclooctane compounds which may be used to provide sustainable aviation fuels. It will be appreciated that embodiments disclosed herein may be employed in a variety of fields and/or operating environments where the functionality disclosed herein may be useful. Accordingly, the scope of the claims should not be construed to be limited to the exemplary implementations and operating environments disclosed herein.

In one embodiment, a composition includes at least one n-alkane, at least one iso-alkane or a mixture thereof. The composition also includes one or more compounds according to formula (I)

(I)

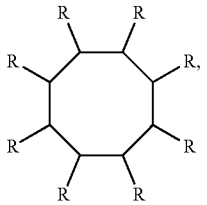

where each R independently represents a hydrogen atom or an alkyl group. The composition exhibits a density greater than 0.775 g/mL, and a derived cetane number greater than 30; wherein comprises between about 50% to about 95% by weight of the one or more compounds according to formula (I) and between about 5% to about 50% by weight of the mixture of the at least one n-alkane and the at least one iso-alkane.

Regarding the one or more compounds according to formula (I), one non-limiting approach for preparing the same is described in U.S. Pat. No. 10,981,846, the contents of which are incorporated herein by reference in their entirety. More particular but non-limiting compounds according to formula (I) which may be included in the compositions described herein, either alone or in some combination, include the following:

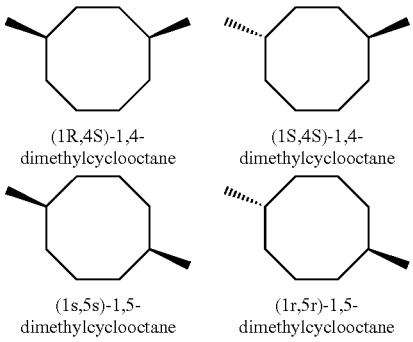

These compounds may include (1R,4S)-1,4-dimethylcyclooctane, (1S,4S)-1,4-dimethylcyclooctane, (1s,5s)-1,5-dimethylcyclooctane, (1r,5r)-1,5-dimethylcyclooctane. "DMCO" may be used herein to refer to any of these compounds individually or to any combination thereof. These compounds may be prepared in accordance with the following reaction scheme:

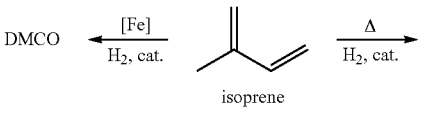

-continued

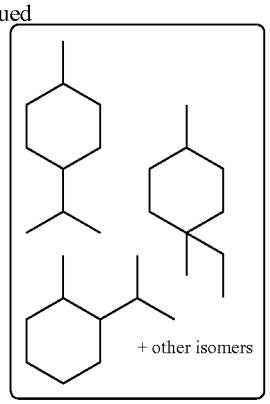

HID

In an embodiment, a method may be provided for producing a 1,4-dimethylcyclooctane (DMCO) from isoprene through an iron-catalyzed hydrogenation process. In this reaction scheme, isoprene may undergo dimerization and subsequent hydrogenation in the presence of an iron-based catalyst under hydrogenation conditions to form DMCO. In an embodiment, isoprene starting material may include a mixture of isoprene monomers obtained from renewable or petrochemical feedstocks. During the hydrogenation step, a catalyst comprising iron, optionally with supporting ligands, may be exposed to hydrogen to promote the conversion of isoprene to DMCO with controlled selectivity. As a side product, a hydrogenated isoprene dimers (HID) fraction may be formed, comprising a range of saturated C10 cycloalkane isomers. In an embodiment, HID fraction may include 1-isopropyl-4-methylcyclohexane, 1-ethyl-1,4-dimethylcyclohexane, 1-isopropyl-2-methylcyclohexane and other branched cycloalkanes. In this reaction scheme, HID is representative of hydrogenated isoprene dimers (HID) which are also a product of the reaction scheme, and HID may also include about 10% to about 15% by weight of DMCO. HID may additionally or alternatively be representative of compounds having one of the following structures:

1

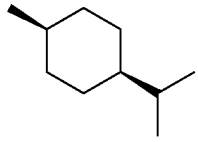

2

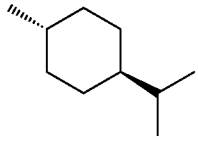

3

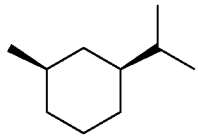

4

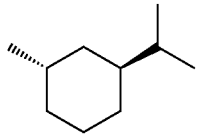

-continued

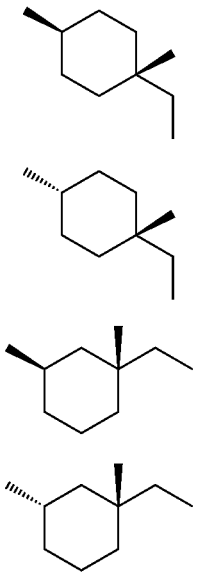

In one or more embodiment, HIDs may include (1s,4s)-1-isopropyl-4-methylcyclohexane (1), (1s,4s)-1-ethyl-1,4-dimethylcyclohexane (2), (1S,3R)-1-isopropyl-3-methylcyclohexane (3), (1S,3S)-1-isopropyl-3-methylcyclohexane (4), (1r,4r)-1-ethyl-1,4-dimethylcyclohexane (5), (1r,4r)-1-isopropyl-4-methylcyclohexane (6), (1R,3S)-1-ethyl-1,3-dimethylcyclohexane (7), (1R,3R)-1-ethyl-1,3-dimethylcyclohexane (8). In some forms, the compositions described herein may include one or more of the compounds represented by HID.

In one or more embodiments, one or more compositions may include one or more n-alkanes, one or more iso-alkanes, or a mixture of one or more n-alkanes and one or more iso-alkanes. When a mixture of one or more n-alkanes and one or more iso-alkanes is included, the one or more n-alkanes and one or more iso-alkanes may include those found in hydrogen processed esters and fatty acid compositions known as hydroprocessed esters and fatty acids (HEFA) or HEFA-Jet. In one or more embodiments, various embodiments of HEFA may include HEFA-SPK (Hydroprocessed Esters and Fatty Acids-Synthetic Paraffinic Kerosene), and HVO (Hydrotreated Vegetable Oil). However, the inclusion of additional and/or alternative n-alkanes and/or iso-alkanes may also be possible and contemplated. In some forms, the n-alkane may include n-decane, the iso-alkane may include iso-decane, and the mixture may include n-decane and iso-decane not limiting examples of which include 2-methyl nonane, 3-methyl nonane, 4-methyl nonane, 2,2-dimethyl octane, 3,3-dimethyl octane, 4,4-dimethyl octane, 2,3-dimethyl octane, 2,4-dimethyl octane, 2,5-dimethyl octane, 2,6-dimethyl octane, 2,7-dimethyl octane, 3,4-dimethyl octane, 3,5-dimethyl octane, 3,6-dimethyl octane, 2,2,3-trimethyl heptane, 2,2,4-trimethyl heptane, 2,2,5-trimethyl heptane, 2,2,6-trimethyl heptane, 2,3,3-trimethyl heptane, 2,3,4-trimethyl heptane, 2,3,5-trimethyl heptane, 2,3,6-trimethyl heptane, 3,3,4-trimethyl heptane, 2,2,3,3-tetramethyl hexane, 2,2,4,4-tetramethyl hexane, 2,2,5,5-tetramethyl hexane, 2,3,3,4-tetramethyl hexane, 2,3,3,5-tetramethyl hexane, 2,3,4,5-tetramethyl hexane, 2,2,3,3,4-pentamethyl pentane and 2,2,3,4,4-pentamethyl pentane.

The amount of the one or more compounds according to formula (I) and the at least one n-alkane, the at least one iso-alkane or the mixture thereof may be varied depending on various properties of the one or more compounds according to formula (I) and the at least one n-alkane, the at least one iso-alkane or the mixture thereof as necessary to provide the composition with desired properties or characteristics. In one aspect, these properties or characteristics are those necessary to satisfy the requirements of ASTM D7566 for aviation fuel, although satisfaction of other standards is possible and contemplated. In one form for example, the one or more compounds according to formula (I) may be present in an amount that accounts for the density of the at least one n-alkane, the at least one iso-alkane or the mixture thereof such that the composition exhibits or includes a density which satisfies the density requirement of ASTM D7566. In these forms, a composition may exhibit or include a density greater than 0.775 g/mL, although other variations are possible and contemplated. For example, a density may be greater than about 0.78 g/mL, greater than about 0.785 g/mL, greater than about 0.79 g/mL, greater than about 0.795 g/mL, greater than about 0.8 g/mL, greater than about 0.805 g/mL, greater than about 0.81 g/mL, greater than about 0.815 g/mL, greater than about 0.82 g/mL, greater than about 0.825 g/mL, greater than about 0.83 g/mL, or greater than about 0.835 g/mL or may be in a range defined by one or more of these values. In one or more forms, a composition may exhibit or include a density which is greater than one of an aforementioned value and less than about 0.84 g/mL. In some cases, a density of a composition may increase as an amount of one or more compounds according to formula (I) present in a composition increases.

Additionally or alternatively, one or more compounds according to formula (I) and/or at least one n-alkane, at least one iso-alkane or a mixture thereof may be present in amounts that provide a composition with a derived cetane number (DCN) greater than 30, although other variations are possible and contemplated. For example, a derived cetane number may be greater than about 32; greater than about 34, greater than about 36, greater than about 38, greater than about 40, greater than about 42, greater than about 44, greater than about 46, greater than about 48, greater than about 50, greater than about 60, greater than about 70, greater than about 80, greater than about 90 or may be in a range defined by one or more of these values. In one or more forms, a composition may exhibit or include a derived cetane number which is greater than one of the aforementioned values and less than about 100. In some cases, a derived cetane number of the composition will decrease as the amount of the one or more compounds according to formula (I) present in the composition increases.

In some forms, one or more compounds according to formula (I) may be present at about 1% to about 99% by weight based on the total weight of the composition. However, other variations are contemplated and possible. For example, one or more compounds according to formula (I) may be present at about 20% to about 95% by weight based on a total weight of the composition, at about 25% to about 80% by weight based on a total weight of the composition, at about 30% to about 70% by weight based on a total weight of the composition, at about 40% to about 60% by weight based on a total weight of the composition, at about 50% to about 99% by weight based on a total weight of the composition, at about 33% to about 66% by weight based on a total weight of the composition, or in any range defined by one or more of these values.

The mixture of n-alkanes and iso-alkanes, when included in a composition, may be present at about 1% to about 99% by weight based on a total weight of a composition. However, other variations are contemplated and possible. For example, a mixture may be present at about 5% to about 80% by weight based on a total weight of the composition, at about 20% to about 80% by weight based on the total weight of the composition, at about 50% to about 80% by weight based on a total weight of the composition, at about 40% to about 80% by weight based on a total weight of the composition, at about 50% to about 80% by weight based on a total weight of the composition, at about 60% to about 80% by weight based on a total weight of the composition, at about 70% to about 80% by weight based on a total weight of the composition, at about 33% to about 66% by weight based on a total weight of the composition or in any range defined by one or more of these values.

One particular but non-limiting composition includes DMCO and HEFA, and the following Table 1 provides various weight ratios between these components and the estimated or tested density and the estimated or tested DCN of the composition for each variation. The DCN for DMCO was calculated to be 8.1 based upon the 44 DCN for the 30:70 blend which was tested using a DCN of 59.4 for HEFA identified by a National Renewable Energy Laboratory report titled "Comparison of Derived Cetane Number and Indicated Cetane Number for Jet Fuels and Correlation with Lean Blowout" authored by Jon Luecke, Ian Mylrea, Josh Heyne, and Bob McCormick and presented at the CRC Aviation Committee held in Alexandria, VA, USA on Apr. 29-May 2, 2024. The calculated DCN for DMCO was then used for calculating the estimated DCN values in Table 1.

TABLE 1

Weight ratios between DMCO and HEFA and the estimated or tested density and the estimated or tested DCN of the composition for each variation.

| DMCO:HEFA | Estimated or **Tested Density g/mL | Estimated or **Tested DCN |
|---|---|---|
| 20:80 | 0.775 | 49.1 |
| 30:70 | 0.780** | 44.0** |
| 40:60 | 0.788 | 38.9 |
| 50:50 | 0.795 | 33.8 |
| 60:40 | 0.801 | 28.6 |
| 80:20 | 0.814 | 18.4 |
| 95:5 | 0.824 | 10.7 |

In forms in which a composition includes n-alkanes in lieu of a mixture of n-alkanes and iso-alkanes, the n-alkanes may be present at about 40% to about 60% by weight based on the total weight of the composition, although other variations are contemplated. For example, in some forms n-alkanes may be present at about 42% to about 58% by weight based on a total weight of the composition, at about 44% to about 56% by weight based on a total weight of the composition, at about 46% to about 54% by weight based on the total weight of a composition, or an any range which may be defined by one or more of these values. In one particular but non-limiting form where the n-alkane is n-decane, it may be present between at 52% to about 54%, such as 53.6%, by weight based on a total weight of the composition and the one or more compounds according to formula (I) may be present between at about 45% to about 47%, such as 46.4%, by weight based on a total weight of a composition in order to provide a composition having a density greater than 0.775 g/mL.

In forms in which a composition includes iso-alkanes in lieu of a mixture of n-alkanes and iso-alkanes, the iso-alkanes may be present at about 40% to about 60% by weight based on a total weight of the composition, although other variations are contemplated. For example, in some forms the iso-alkanes may be present at about 42% to about 58% by weight based on a total weight of a composition, at about 44% to about 56% by weight based on a total weight of a composition, at about 46% to about 54% by weight based on a total weight of a composition, at about 48% to about 52% by weight based on a total weight of the composition or an any range which may be derived by one or more of these values. In one particular but non-limiting form where the iso-alkane is iso-decane, it may be present at about 48% to about 50%, such as 48.6%, by weight based on a total weight of a composition and the one or more compounds according to formula (I) may be present at about 50% to about 52%, such as 51.4%, by weight based on a total weight of a composition in order to provide a composition having a density greater than 0.775 g/mL.

In some forms, the compositions described herein may be entirely or substantially free of any petroleum-based of petroleum-derived compounds, although forms in which at least some petroleum-based or petroleum-derived compounds are present are contemplated. In some forms, a composition may include less than about 0.1%, less than about 0.2%, less than about 0.4%, less than about 0.6%, less than about 0.8%, less than about 1%, less than about 2%, less than about 5% or less than about 10% by weight based on a total weight of a composition of any petroleum-based or petroleum-derived compounds.

In some forms, compositions described herein may be entirely or substantially free of any aromatic compounds, although forms in which at least some aromatic compounds are present are contemplated. In some forms, compositions may include less than about 0.1%, less than about 0.2%, less than about 0.4%, less than about 0.6%, less than about 0.8%, less than about 1%, less than about 2%, less than about 5% or less than about 10% by weight based on a total weight of a composition of any aromatic compounds.

To facilitate the understanding of this invention, a number of terms are defined below and throughout the disclosure. Unless otherwise defined, all technical and scientific terms used herein have the same meaning as commonly understood by one of ordinary skill in the art to which this invention belongs. The terminology herein is used to describe specific embodiments of the invention, but their usage does not limit the invention, except as outlined in the claims.

It is understood that the acts described below are meant as a general overview and demonstration of an exemplary method, and that the method may include different and/or additional acts as described herein or otherwise.

While the present invention will be described as having particular configurations disclosed herein, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

It is to be understood that any aspect and/or element of any embodiment of the method(s) described herein or otherwise may be combined in any way to form additional embodiments of the method(s) all of which are within the scope of the method(s).

Where a process is described herein, those of ordinary skill in the art will appreciate that the process may operate without any user intervention. In another embodiment, the process includes some human intervention (for example, a step is performed by or with the assistance of a human).

For the purposes of this disclosure, including the claims, the phrase "at least some" means "one or more" and includes the case of only one. Thus, for example, the phrase "at least some ABCs" means "one or more ABCs" and includes the case of only one ABC.

For the purposes of this disclosure, including the claims, the term "at least one" should be understood as meaning "one or more" and therefore includes both embodiments that include one or multiple components. Furthermore, dependent claims that refer to independent claims that describe features with "at least one" have the same meaning, both when the feature is referred to as "the" and "the at least one."

For the purposes of this disclosure, the term "portion" means some or all. Therefore, for example, "A portion of X" may include some of "X" or all of "X." In the context of a conversation, the term "portion" means some or all of the conversation.

For the purposes of this disclosure, including the claims, the phrase "using" means "using at least" and is not exclusive. Thus, for example, the phrase "using X" means "using at least X." Unless specifically stated by use of the word "only," the phrase "using X" does not mean "using only X."

For the purposes of, this disclosure, including the claims, the phrase "based on" means "based in part on" or "based, at least in part, on" and is not exclusive. Thus, for example, the phrase "based on factor X" means "based in part on factor X" or "based, at least in part, on factor X." Unless specifically stated by use of the word "only," the phrase "based on X" does not mean "based only on X."

In general, for the purposes of this disclosure, including the claims, unless the word "only" is specifically used in a phrase, it should not be read into that phrase.

For the purposes of this disclosure, including the claims, the phrase "distinct" means "at least partially distinct." Unless specifically stated, distinct does not mean fully distinct. Thus, for example, the phrase "X is distinct from Y" means that "X is at least partially distinct from Y" and does not mean that "X is fully distinct from Y." Thus, for the purposes of this disclosure, including the claims, the phrase "X is distinct from Y" means that X differs from Y in at least some way.

It should be appreciated that the words "first," "second," and so on, in the description and claims, are used to distinguish or identify, and not to show a serial or numerical limitation.

Similarly, letter labels (for example, "(A)," "(B)," "(C)," and so on, or "(a)," "(b)," and so on) and/or numbers (for example, "(i)," "(ii)," and so on) are used to assist in readability and to help distinguish or identify, and are not intended to be otherwise limiting or to impose or imply any serial or numerical limitations or orderings. Similarly, words such as "particular," "specific," "certain," and "given," in the description and claims, if used, are to distinguish or identify, and are not intended to be otherwise limiting.

For the purposes of this disclosure, including the claims, the terms "multiple" and "plurality" mean "two or more," and include the case of "two." Thus, for example, the phrase "multiple ABCs" means "two or more ABCs" and includes "two ABCs." Similarly, for example, the phrase "multiple PQRs" means "two or more PQRs" and includes "two PQRs."

The present invention also covers the exact terms, features, values, and ranges, etc., in case these terms, features, values, and ranges, etc., are used in conjunction with terms such as "about," "around," "generally," "substantially," "essentially," "at least," etc. Thus, for example, "about 3" or "approximately 3" shall also cover exactly 3, and "substantially constant" shall also cover exactly constant.

For the purposes of this disclosure, unless stated otherwise, the terms "about" or "approximately" refer to a value that is within 10% above or below the value being described.

For the purposes of this disclosure, including the claims, singular forms of terms are to be construed as also including the plural form and vice versa, unless the context indicates otherwise. Thus, it should be noted that for the purposes of this disclosure, the singular forms "a," "an," and "the" include plural references unless the context clearly dictates otherwise. In other words, terms such as "a," "an," and "the" are not intended to refer to only a singular entity but include the general class of which a specific example may be used for illustration.

Throughout the description and claims, the terms "comprise," "including," "having," "contain," and their variations should be understood as meaning "including but not limited to" and are not intended to exclude other components unless specifically so stated.

It will be appreciated that variations to the embodiments of the invention can be made while still falling within the scope of the invention. Alternative features serving the same, equivalent, or similar purpose can replace features disclosed in the specification, unless stated otherwise. Thus, unless stated otherwise, each feature disclosed represents one example of a generic series of equivalent or similar features.

Use of exemplary language, such as "for instance," "such as," "for example" ("e.g.,") and the like, is merely intended to better illustrate the invention and does not indicate a limitation on the scope of the invention unless specifically so claimed.

While the invention has been described in connection with what is presently considered to be the most practical and embodiments thereof are further described in the examples below, it is to be understood that the invention is not to be limited to the disclosed embodiment, but on the contrary, is intended to cover various modifications and equivalent arrangements included within the spirit and scope of the appended claims.

The following description sets forth various examples along with specific details to provide a thorough understanding of claimed subject matter. It will be understood by those skilled in the art, however, that claimed subject matter may be practiced without one or more of the specific details disclosed herein. Further, in some circumstances, well-known methods, procedures, systems, and/or components have not been described in detail in order to avoid unnecessarily obscuring claimed subject matter. The illustrative embodiments described in the detailed description and claims are not meant to be limiting. Other embodiments may be utilized, and other changes may be made, without departing from the spirit or scope of the subject matter presented here. It will be readily understood that the aspects of the present disclosure, as generally described herein, can be arranged, substituted, combined, and designed in a wide variety of different configurations, all of which are explicitly contemplated and make part of this disclosure.

Definitions

Definitions of specific functional groups and chemical terms are described in more detail below. For purposes of this invention, the chemical elements are identified in accordance with the Periodic Table of the Elements, Chemical Abstracts Service (CAS) version of the periodic table of the elements, Handbook of Chemistry and Physics, 106th Ed., inside cover, and specific functional groups are generally defined as described therein. Additionally, general principles of organic chemistry, as well as specific functional moieties and reactivity, are described in Organic Chemistry, Thomas Sorrell, 2nd Edition, University Science Books, 2006; Smith, March's Advanced Organic Chemistry: Reactions, Mechanisms, and Structure, 9th Edition, Wiley, 2025; Larock, Comprehensive Organic Transformations, 3rd Edition, Wiley, 2018; Carruthers and Coldham, Modern Methods of Organic Synthesis, 4th Edition, Cambridge University Press, Cambridge, 2004.

The term, "alkyl," as used herein, refers to saturated, straight- or branched-chain hydrocarbon radicals derived from a hydrocarbon moiety containing between one and twenty carbon atoms by removal of a single hydrogen atom. In some embodiments, the alkyl group employed in the invention contains 1-20 carbon atoms (C1-20 alkyl). In another embodiment the alkyl group contains 1-15 carbon atoms (C1-15 alkyl), in another embodiment the alkyl group contains 1-10 carbon atoms (C1-10 alkyl). In another embodiment the alkyl group contains 1-8 carbon atoms (C1-8 alkyl). In another embodiment the alkyl group contains 1-6 carbon atoms (C1-6 alkyl). In another embodiment the alkyl group contains 1-5 carbon atoms (C1-5 alkyl). In another embodiment the alkyl group contains 1-4 carbon atoms (C1-4 alkyl). In another embodiment the alkyl group contains 1-3 carbon atoms (C1-3 alkyl). In another embodiment, the alkyl group contains 1-2 carbon atoms (C1-2 alkyl), with examples of alkyl radicals including, but not limited to, methyl, ethyl, n-propyl, isopropyl, n-butyl, sec-butyl, iso-butyl, tert-butyl, n-pentyl, neopentyl, n-hexyl, sec-hexyl, n-heptyl, n-octyl, n-decyl, n-undecyl, dodecyl, and the like, which may bear one or more substituents, and alkyl group substituents include, but are not limited to, any of the substituents described herein that result in the formation of a stable moiety. The term "alkylene," as used herein, refers to a biradical derived from an alkyl group as defined herein by removal of two hydrogen atoms. An alkylene group may be cyclic or acyclic. It may also be branched or unbranched. An alkylene group may be substituted or unsubstituted. Substituents on the alkylene group may include, but are not limited to, any of the substituents described herein that result in the formation of a stable moiety.

The term, "aryl," as used herein, refers to an aromatic mono- or polycyclic ring system having 3-20 ring atoms, of which all the ring atoms are carbon, and which may be substituted or unsubstituted. In certain embodiments of the present invention, "aryl" refers to a mono, bi, or tricyclic C4-C20 aromatic ring system having one, two, or three aromatic rings which include, but are not limited to, phenyl, biphenyl, naphthyl, and the like, which may bear one or more substituents. Aryl substituents include, but are not limited to, any of the substituents described herein, that result in the formation of a stable moiety.

The term, "arylene," as used herein refers to an aryl biradical derived from an aryl group, as defined herein, by removal of two hydrogen atoms. Arylene groups may be substituted or unsubstituted. Arylene group substituents include, but are not limited to, any of the substituents described herein; that result in the formation of a stable moiety. Additionally, arylene groups may be incorporated as a linker group into an alkylene, alkenylene, alkynylene, heteroalkylene, heteroalkenylene, or heteroalkynylene group, as defined herein.

The term, "heteroaryl," as used herein, refers to an aromatic mono- or polycyclic ring system having 3-20 ring atoms, of which one ring atom is selected from S, O, and N; zero, one, or two ring atoms are additional heteroatoms independently selected from S, O, and N; and the remaining ring atoms are carbon, the radical being joined to the rest of the molecule via any of the ring atoms. Exemplary heteroaryls include, but are not limited to pyrrolyl, pyrazolyl, imidazolyl, pyridinyl, pyrimidinyl, pyrazinyl, pyridazinyl, triazinyl, tetrazinyl, pyyrolizinyl, indolyl, quinolinyl, isoquinolinyl, benzoimidazolyl, indazolyl, quinolinyl, isoquinolinyl, quinolizinyl, cinnolinyl, quinazolynyl, phthalazinyl, naphthridinyl, quinoxalinyl, thiophenyl, thianaphthenyl, furanyl, benzofuranyl, benzothiazolyl, thiazolynyl, isothiazolyl, thiadiazolynyl, oxazolyl, isoxazolyl, oxadiaziolyl, oxadiaziolyl, and the like, which may bear one or more substituents. Heteroaryl substituents include, but are not limited to, any of the substituents described herein, that result in the formation of a stable moiety.

The term, "heteroarylene," as used herein, refers to a biradical derived from an heteroaryl group, as defined herein, by removal of two hydrogen atoms. Heteroarylene groups may be substituted or unsubstituted. Additionally, heteroarylene groups may be incorporated as a linker group into an alkylene, alkenylene, alkynylene, heteroalkylene, heteroalkenylene, or heteroalkynylene group, as defined herein. Heteroarylene group substituents include, but are not limited to, any of the substituents described herein, which result in the formation of a stable moiety.

At a high level, aspects of the present disclosure are directed to cyclooctane containing fuel composition.

Exemplary embodiments illustrating aspects of the present disclosure are described below in the context of several specific examples.

Aspects of the present disclosure can be used as a method for blending at least one n-alkane, at least one iso-alkane or a mixture thereof, and one or more compounds according to formula (I), wherein each R independently represents a hydrogen atom or an alkyl group, to provide a composition exhibiting a density greater than 0.775 g/mL and a derived cetane number greater than 30; wherein comprises between about 50% to about 95% by weight of the one or more compounds according to formula (I) and between about 5% to about 50% by weight of the mixture of the at least one n-alkane and the at least one iso-alkane.

Aspects of the present can be used to an a composition includes at least one n-alkane, at least one iso-alkane or a mixture thereof, one or more compounds according to formula (I), where each R independently represents a hydrogen atom or an alkyl group, a density greater than 0.775 g/mL, and a derived cetane number greater than 30; wherein comprises between about 50% to about 95% by weight of the one or more compounds according to formula (I) and between about 5% to about 50% by weight of the mixture of the at least one n-alkane and the at least one iso-alkane.

Referring now to FIG. 1, an exemplary method 100 for making cyclooctane containing fuel composition is illustrated. At step 105, method 100 includes blending at least one n-alkane, at least one iso-alkane or a mixture thereof, with one or more compounds according to formula (I)

(I)

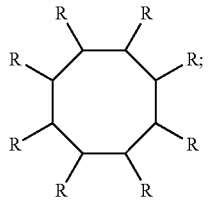

wherein each R independently represents a hydrogen atom or an or an alkyl group to make a composition. In one or more embodiments, formula (I) may include (1R,4S)-1,4-dimethylcyclooctane, (1S,4S)-1,4-dimethylcyclooctane, (1s,5s)-1,5-dimethylcyclooctane, (1r,5r)-1,5-dimethylcyclooctane. In one or more embodiments, a composition includes between about 50% to about 95% by weight of the one or more compounds according to formula (I) and between about 5% to about 50% by weight of the mixture of the at least one n-alkane and the at least one iso-alkane.

With continued reference to FIG. 1, one or more compounds according to formula (I) may include one or more of a following: (1R,4S)-1,4-dimethylcyclooctane, (1S,4S)-1,4-dimethylcyclooctane, (1s,5s)-1,5-dimethylcyclooctane, (1r,5r)-1,5-dimethylcyclooctane.

With continued reference to FIG. 1, one or more compounds may include one or more n-alkanes, one or more iso-alkanes, or a mixture of one or more n-alkanes and one or more iso-alkanes. When a mixture of one or more n-alkanes and one or more iso-alkanes is included, the one or more n-alkanes and one or more iso-alkanes may include those found in hydrogen processed esters and fatty acid compositions known as hydroprocessed esters and fatty acids (HEFA) or HEFA-Jet. In one or more embodiments, various embodiments of HEFA may include HEFA-SPK (Hydroprocessed Esters and Fatty Acids-Synthetic Paraffinic Kerosene), and HVO (Hydrotreated Vegetable Oil). However, the inclusion of additional and/or alternative n-alkanes and/or iso-alkanes may also be possible and contemplated. In some forms, the n-alkane may include n-decane, the iso-alkane may include iso-decane, and the mixture may include n-decane and iso-decane not limiting examples of which include 2-methyl nonane, 3-methyl nonane, 4-methyl nonane, 2,2-dimethyl octane, 3,3-dimethyl octane, 4,4-dimethyl octane, 2,3-dimethyl octane, 2,4-dimethyl octane, 2,5-dimethyl octane, 2,6-dimethyl octane, 2,7-dimethyl octane, 3,4-dimethyl octane, 3,5-dimethyl octane, 3,6-dimethyl octane, 2,2,3-trimethyl heptane, 2,2,4-trimethyl heptane, 2,2,5-trimethyl heptane, 2,2,6-trimethyl heptane, 2,3,3-trimethyl heptane, 2,3,4-trimethyl heptane, 2,3,5-trimethyl heptane, 2,3,6-trimethyl heptane, 3,3,4-trimethyl heptane, 2,2,3,3-tetramethyl hexane, 2,2,4,4-tetramethyl hexane, 2,2,5,5-tetramethyl hexane, 2,3,3,4-tetramethyl hexane, 2,3,3,5-tetramethyl hexane, 2,3,4,5-tetramethyl hexane, 2,2,3,3,4-pentamethyl pentane and 2,2,3,4,4-pentamethyl pentane.

With continued reference to FIG. 1, a composition may further include one or more compounds including (1s,4s)-1-isopropyl-4-methylcyclohexane (1), (1s,4s)-1-ethyl-1,4-dimethylcyclohexane (2), (1S,3R)-1-isopropyl-3-methylcyclohexane (3), (1S,3S)-1-isopropyl-3-methylcyclohexane (4), (1r,4r)-1-ethyl-1,4-dimethylcyclohexane (5), (1r,4r)-1-isopropyl-4-methylcyclohexane (6), (1R,3S)-1-ethyl-1,3-dimethylcyclohexane (7), (1R,3R)-1-ethyl-1,3-dimethylcyclohexane (8).

With continued reference to FIG. 1, one or more compounds may be free of any aryl containing, arylene containing, heteroaryl containing, and heteroarylene containing compounds. For example, and without limitation, aryl may include phenyl, biphenyl, naphthyl, and the like. For example and without limitation, heteroaryl may include pyrrolyl, pyrazolyl, imidazolyl, pyridinyl, pyrimidinyl, pyrazinyl, pyridazinyl, triazinyl, tetrazinyl, pyyrolizinyl, indolyl, quinolinyl, isoquinolinyl, benzoimidazolyl, indazolyl, quinolinyl, isoquinolinyl, quinolizinyl, cinnolinyl, quinazolynyl, phthalazinyl, naphthridinyl, quinoxalinyl, thiophenyl, thianaphthenyl, furanyl, benzofuranyl, benzothiazolyl, thiazolynyl, isothiazolyl, thiadiazolynyl, oxazolyl, isoxazolyl, oxadiaziolyl, oxadiaziolyl, and the like.

With continued reference to FIG. 1, in one or more embodiments, one or more compounds may be free of any petroleum-based compounds. "Petroleum-based compounds," as used in this disclosure, are substances that are associated with petroleum production and are derived from the processing of crude oil or natural gas, rather than produced through chemical synthesis in a laboratory setting. In one or more embodiments, petroleum-based compounds may include, but are not limited to, alkanes (e.g., hexane, heptane, octane, decane), cycloalkanes (e.g., cyclohexane, methylcyclohexane), aromatic hydrocarbons (e.g., benzene, toluene, xylene, ethylbenzene, naphthalene), polycyclic aromatics (e.g., anthracene, phenanthrene), petroleum distillates (e.g., kerosene, diesel, naphtha, jet fuel), lubricating oils, paraffin wax, petroleum waxes, asphalt, and liquefied petroleum gases (e.g., propane and butane). In one or more embodiments, petroleum-based compounds may include all hydrocarbons that are extracted from or refined from petroleum or petroleum fractions.

With continued reference to FIG. 1, in one or more embodiments, one or more compounds may include petroleum-based compounds. In one or more embodiments, one or more compounds may be blended with petroleum-based fuels, including but are not limited to jet fuel, diesel, or gasoline, to form blended fuels suitable for aviation and other transportation applications. In one or more embodiments, blending may be necessary to ensure compatibility with existing fuel systems, particularly to maintain elastomeric seal swelling performance and avoid seal shrinkage, which may occur when neat alternative fuels lack aromatic or cycloalkane content. For example, and without limitation, petroleum-based aromatics in conventional jet fuel may contribute to the swelling of nitrile rubber or fluorosilicone elastomeric seals, thereby preserving sealing function and preventing fuel leakage. In one or more embodiments, fuels produced through pathways such as Gas-to-Liquids (GTL) or Hydroprocessed Esters and Fatty Acids (HEFA) may have low aromatic content, which may lead to insufficient swelling of elastomeric seals. In one or more embodiments, one or more compounds according to the present disclosure may be blended with petroleum-based fuels to achieve suitable aromatics concentration, fuel density, and seal swell behavior for safe and reliable operation in aviation or other transport engines. In one or more embodiments, blending one or more compounds with petroleum-based compounds may provide a pathway for reducing fossil carbon emissions while maintaining compatibility with existing infrastructure and engine materials.

With continued reference to FIG. 1, in one or more embodiments, one or more compounds may be mixed with one or more fuel compositions selected from the group consisting of synthetic paraffinic kerosene (SPK), Jet-A fuel, HEFA, HEFA-Jet and L-Jet. In one or more embodiments, one or more compounds may be premixed with these fuel compositions prior to distribution or storage. For example, and without limitation, by combining one or more compounds with a bulk fuel in a blending tank or fuel depot. In one or more embodiments, one or more compounds may be added later as a separate additive, depending on a fuel environment or a measured swelling performance of an elastomeric seal exposed to fuel. For example, and without limitation, one or more compounds may be injected into a fuel stream through an additive injection system downstream of a storage tank or at an aircraft refueling point to allow on-demand dosing based on observed seal shrinkage or compatibility requirements. In one or more embodiments, addition of one or more compounds may serve as a swelling additive to support elastomeric seal performance, especially in fuel compositions that lack sufficient aromatic content. In one or more embodiments, fuels typically have low levels of aromatic hydrocarbons may lead to reduced swelling of nitrile or fluorosilicone elastomers, resulting in seal shrinkage and potential leakage. In one or more embodiments, one or more compounds disclosed herein may include structures according to formula (I) that may provide targeted swelling activity through optimized molecular size, polarity, and solubility, while avoiding a higher soot formation, emissions, and toxicity associated with traditional aromatic compounds including but not limited to benzene, toluene, or xylene. In one or more embodiments, one or more compounds may act as swelling agents that include defined cyclic or polycyclic structures with tailored hydrogen-to-carbon ratios that balance fuel compatibility with seal swell performance and may be introduced at concentrations suitable to maintain a stable seal dimension within a system while minimizing negative impacts on combustion emissions.

With continued reference to FIG. 1, a composition may exhibit or include a density greater than 0.775 g/mL, although other variations are possible and contemplated. For example, a density may be greater than about 0.78 g/mL, greater than about 0.785 g/mL, greater than about 0.79 g/mL, greater than about 0.795 g/mL, greater than about 0.8 g/mL, greater than about 0.805 g/mL, greater than about 0.81 g/mL, greater than about 0.815 g/mL, greater than about 0.82 g/mL, greater than about 0.825 g/mL, greater than about 0.83 g/mL, or greater than about 0.835 g/mL or may be in a range defined by one or more of these values. In one or more forms, a composition may exhibit or include a density which is greater than one of an aforementioned values and less than about 0.84 g/mL. Generally speaking, a density of a composition may increase as an amount of the one or more compounds according to formula (I) present in a composition increases.

With continued reference to FIG. 1, one or more compounds according to formula (I) and/or the at least one n-alkane, at least one iso-alkane or the mixture thereof may be present in amounts that provide the composition with a derived cetane number (DCN) greater than 30, although other variations are possible and contemplated. For example, a derived cetane number may be greater than about 32, greater than about 34, greater than about 36, greater than about 38, greater than about 40, greater than about 42, greater than about 44, greater than about 46, greater than about 48, greater than about 50, greater than about 60, greater than about 70, greater than about 80, greater than about 90 or may be in a range defined by one or more of these values. In one or more embodiments, a composition may exhibit or include a derived cetane number which is greater than one of an aforementioned value and less than about 100. Generally speaking, a derived cetane number of a composition will decrease as the amount of one or more compounds according to formula (I) present in the composition increases.

Figure 2:
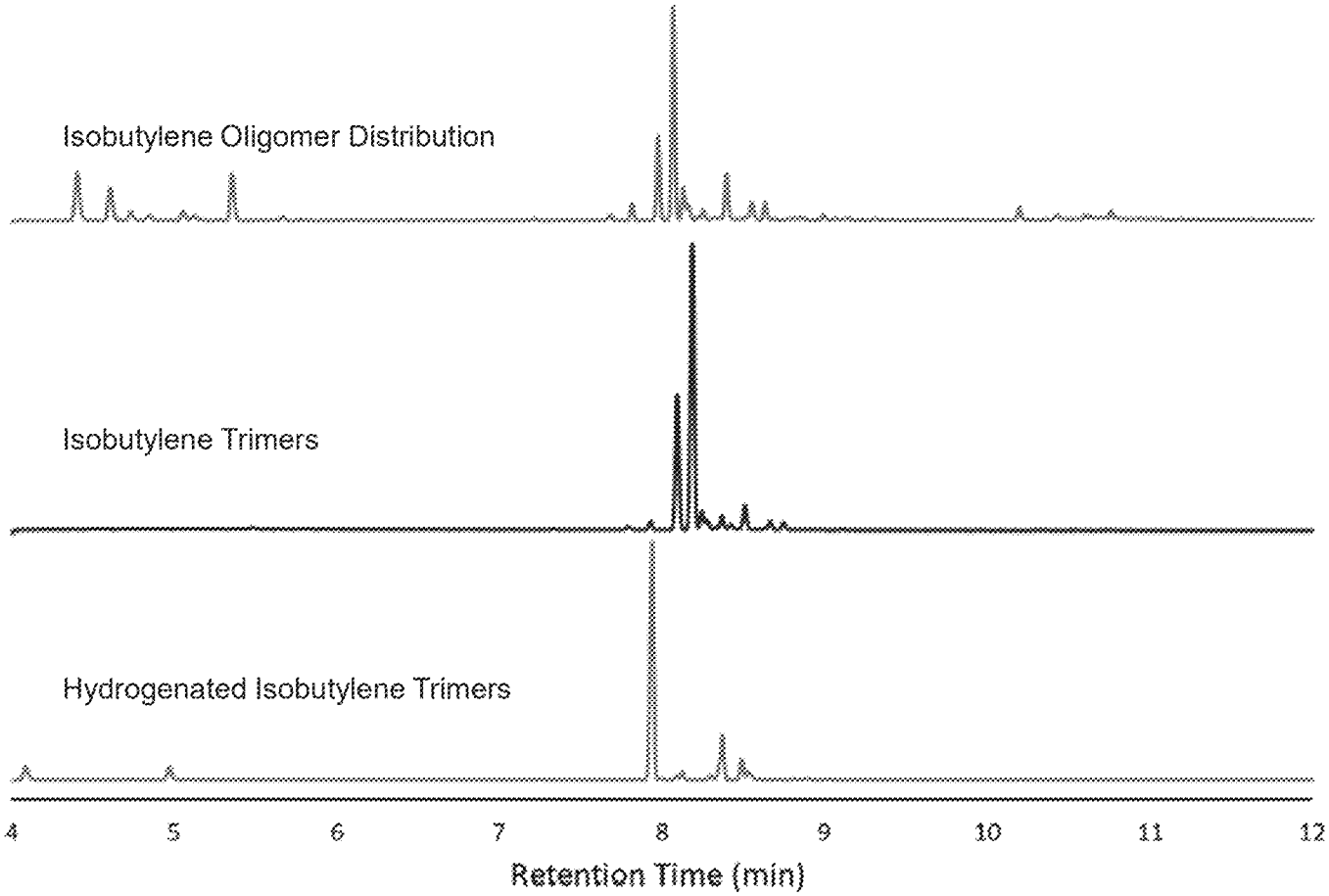
FIG. 2 is an exemplary graphical illustration of gas chromatograms of various compounds.

Referring now to FIG. 2, an exemplary graphical illustration of gas chromatograms of various compounds is illustrated. A composition and conversion efficiency of an oligomerization process may be characterized using gas chromatography (GC). FIG. 2 illustrates gas chromatograms of three stages of the process: the crude isobutylene oligomer mixture (top trace), the purified trimer fraction (middle trace), and the hydrogenated trimer product (HIBT) (bottom trace). In the chromatograms, the x-axis represents the retention time, typically measured in minutes, which reflects the time each compound spends in the GC column before reaching the detector. The y-axis represents detector response, often correlated to the concentration of the compounds present. Each peak on the chromatogram corresponds to a different hydrocarbon compound or class. The relative height or area of each peak reflects its relative abundance in the sample. Isobutylene, a C4 alkene, may be selectively oligomerized and subsequently hydrogenated to produce branched alkanes in the jet fuel boiling range. In one example, a resulting hydrocarbon product consists predominantly of trimers of isobutylene ($C_{12}H_{26}$), which may be referred to as hydrogenated isobutylene trimers (HIBT). These components fall within the carbon number range and volatility suitable for use in sustainable aviation fuel (SAF) formulations. To prepare a HIBT component, isobutylene may be oligomerized in a packed column reactor. A solid acid catalyst such as Amberlyst-15 may be used to facilitate an oligomerization reaction. The reactor may be maintained at a temperature between 95° C. and 100° C. to promote selective conversion of isobutylene. Under these conditions, a product distribution may include approximately 64.4% by weight of isobutylene trimers, 30.4% by weight of dimers ($C_8$ hydrocarbons), and 5.1% by weight of tetramers ($C_{16}$ hydrocarbons). The resulting oligomer mixture may be subjected to a purification step, followed by hydrogenation, to yield a saturated hydrocarbon stream enriched in the trimer fraction (HIBT).

Figure 3:
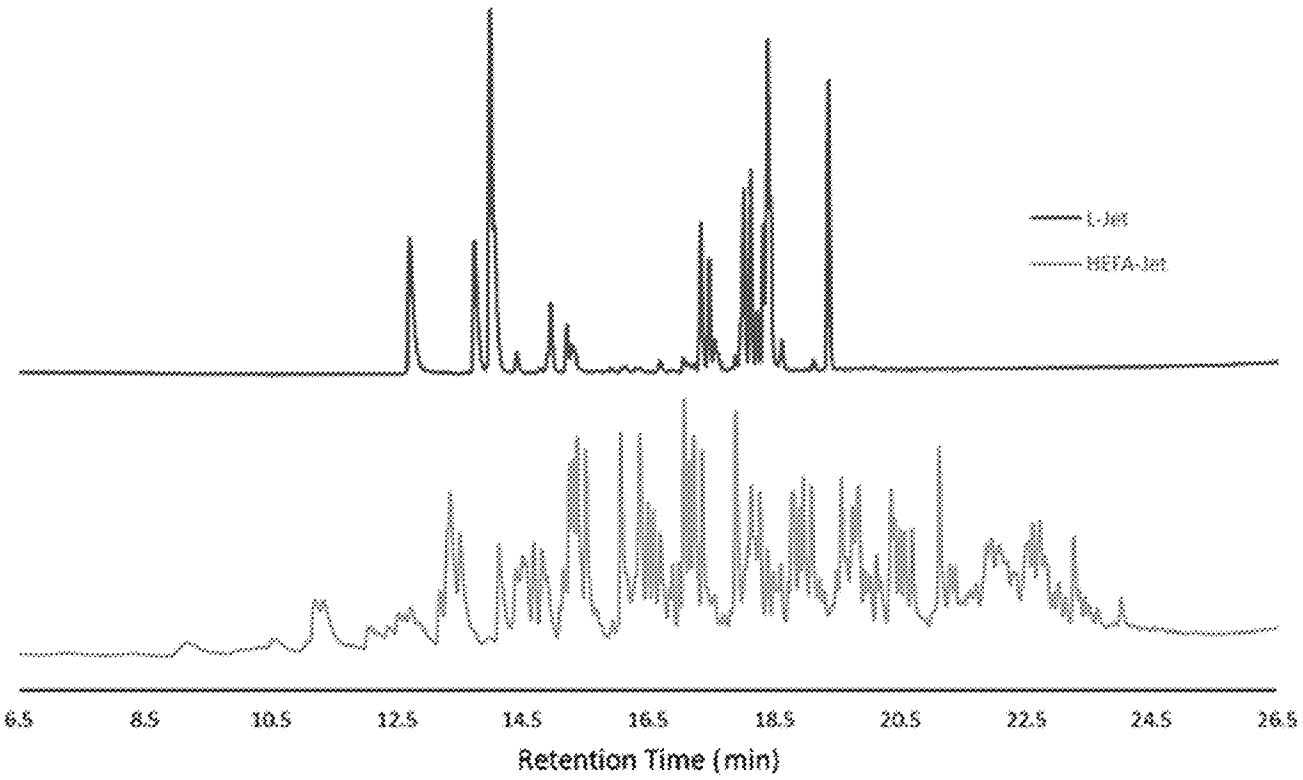
FIG. 3 is an exemplary graphical illustration of gas chromatograms of L-Jet and HEFA-Jet.

Referring now to FIG. 3, an exemplary graphical illustration of gas chromatograms of L-Jet and HEFA-Jet is illustrated. FIG. 3 shows a comparison of a molecular distribution between L-Jet (top) and HEFA-Jet (bottom) using gas chromatography. In both chromatograms, the x-axis represents retention time, which corresponds to the duration each compound requires to pass through the gas chromatography (GC) column. The y-axis denotes detector response, which reflects the relative concentration of each compound. Each peak represents a distinct hydrocarbon compound or class, and the peak height or area indicates its abundance in the sample. The L-Jet formulation was designed to reduce the proportion of HIBT while maintaining compatibility with the expected levels of methylcyclopentadiene and isobutylene produced via ring-closing metathesis. Due to its moderate density, low viscosity, and intermediate gravimetric net heat of combustion (NHOC), p-menthane was selected as a suitable blendstock. A blend was prepared containing 25% p-menthane, 25% 2,6-DMO, 30% RJ-4, and 20% HIBT, herein designated as L-Jet, and was compared to previous HIBT: DMO: RJ-4 mixtures, herein designated as HEFA-Jet. The resulting L-Jet blend demonstrated density, low-temperature viscosity, and combustion energy values comparable to conventional HEFA-jet fuels. In addition, it contained reduced levels of highly branched hydrocarbons (HIBT) and multicyclic hydrocarbons (RJ-4). These hydrocarbons, especially those with five-membered rings, are associated with lower smoke points and increased soot formation. Thus, decreasing the content of HIBT and RJ-4 in the blend is expected to enhance combustion characteristics.

Figure 4:
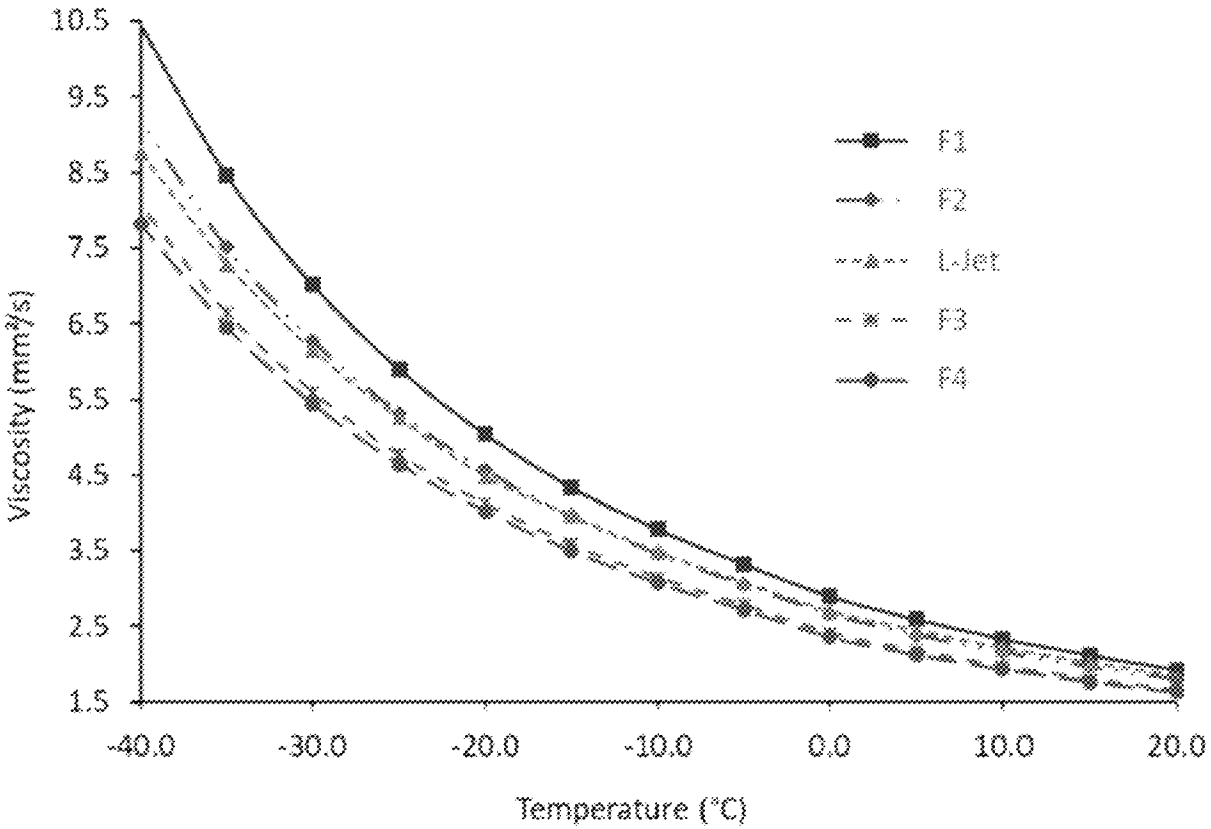
FIG. 4 is an exemplary graphical illustration of kinematic viscosities of various different fuel compositions.

Referring now to FIG. 4, an exemplary graphical illustration of kinematic viscosities of various fuel compositions is illustrated. FIG. 4 presents the kinematic viscosities of five fuel blends (F1, F2, L-Jet, F3, and F4) measured from −40° C. to 20° C. In FIG. 4, the x-axis represents temperature in degrees Celsius, and the y-axis indicates viscosity in units of $mm^2/s$. The viscosity values are accurate within 0.445% at a 95% confidence level. All fuel blends except F2 satisfy the density requirements outlined in ASTM D7566. The density of F2 falls short by only 0.001 g/mL, and a slight increase in HID concentration would correct this deviation. These findings support the effectiveness of sustainable aviation fuel (SAF) blendstocks containing cycloalkanes, which exhibit higher densities than straight or branched acyclic alkanes typically found in bio-based synthetic paraffinic kerosenes. For instance, the 30:70 DMCO: HEFA-Jet blend (F1) shows a 2.4% higher density compared to neat HEFA-Jet. All tested blends meet the kinematic viscosity requirements for Jet-A and ASTM D7566 at −20° C. and −40° C. As shown in FIG. 4, L-Jet consists of C10 and C12 hydrocarbons, while DMCO is a single-component C10 cycloalkane, and HID comprises a mixture of C10 cycloalkanes. All bio-derived blendstocks demonstrate favorable low-temperature viscosity performance. Adding DMCO to HEFA-Jet resulted in viscosity reductions of 11% at −20° C. and 17% at −40° C. HID showed greater impact, with viscosity reductions of 19% and 28% at the respective temperatures. In both cases, the resulting mixtures satisfied the ASTM D7566 viscosity specification at −40° C. (<12.0 $mm^2/s$). The changes in density and viscosity from blending DMCO and HID with Jet-A were less pronounced due to similar baseline properties between the blendstocks and the base fuel.

Figure 5:
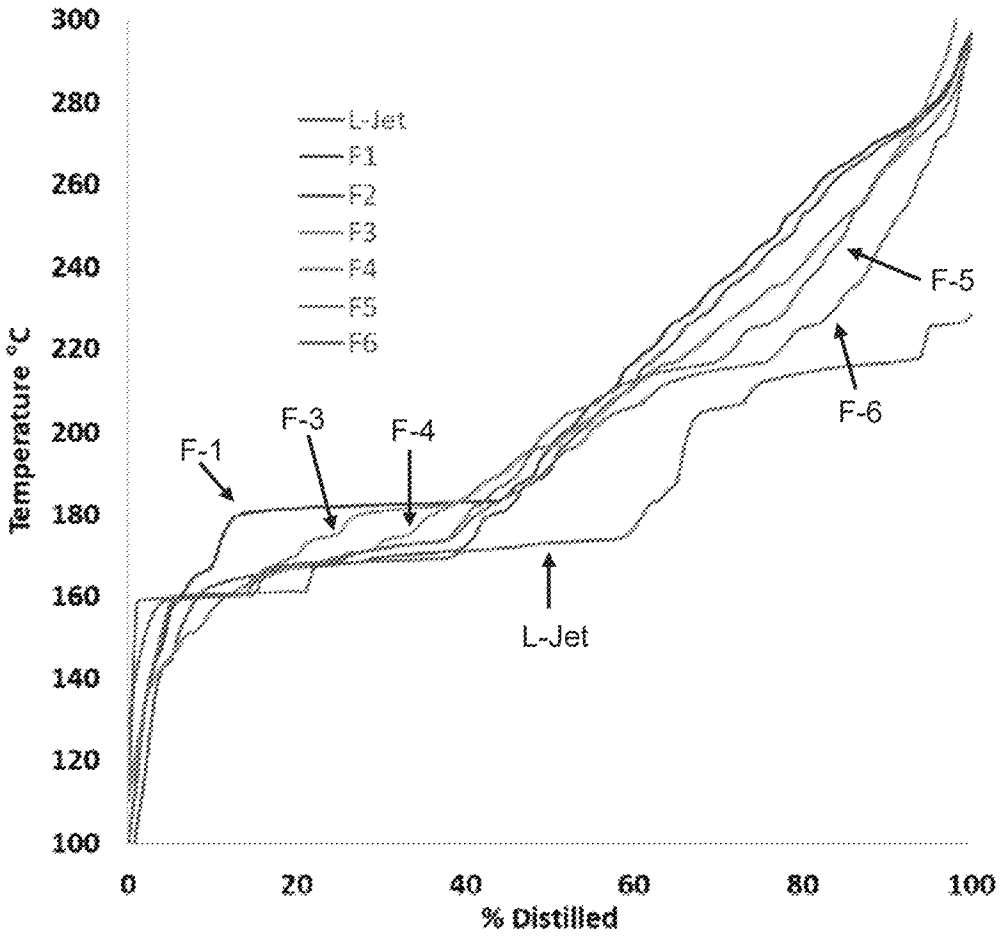
FIG. 5 is an exemplary graphical illustration of simulated distillation curves for various different fuel compositions.

Referring now to FIG. 5, an exemplary graphical illustration of simulated distillation curves for various fuel compositions is illustrated. The x-axis represents the percentage of the fuel distilled, ranging from 0 to 100%, and the y-axis shows the corresponding distillation temperature in degrees Celsius, from 100° C. to 300° C. Simulated distillation provides insight into the molecular composition of each fuel and the relationship between hydrocarbon distribution and boiling behavior. Fuel blends profile includes L-Jet, F1, F2, F3, F4, F5, and F6. To compare the thermal profiles of the fuels, gas chromatography-based distillation curves were generated. According to ASTM D7566, the temperature difference between the points at which 10% and 50% of the fuel distills (T50-T10) must exceed 15° C. Fuels F1 through F4, which include HEFA-Jet or Jet-A as the main component and therefore have broader hydrocarbon distributions, showed T50-T10 values between 28° C. and 40° C., meeting the specification. F1, which contains 30% DMCO, displayed a plateau near 180° C. between 13% and 44% distillation. In contrast, F2, which includes 30% HID, exhibited no plateau and followed a distillation trend similar to F4-F6, attributed to the more complex isomeric composition of HID. L-Jet, composed primarily of C10 and C12 hydrocarbons, showed a narrower boiling range with a T50-T10 value of 13° C., slightly below the ASTM requirement. Multiple plateaus were observed in L-Jet's curve, corresponding to defined boiling points of individual compounds such as 2,6-DMO, p-menthane, and 2,2,4,6,6-pentamethylheptane, along with structurally similar RJ-4 isomers. To address the narrow boiling range of L-Jet, two additional blends were created: F5 and F6, consisting of equal parts L-Jet and either HEFA-Jet or Jet-A, respectively. These blends achieved T50-T10 values of 41° C. and 32° C., demonstrating that the distillation range specification can be met through blending with a broader-range fuel. All fuel blends, including L-Jet, also met the T90-T10 requirement of ASTM D7566 (>40° C.). T90-T10 values ranged from 104° C. to 108° C. for F1-F4, while L-Jet exhibited a value of 56° C.

Figure 6:
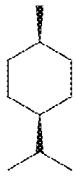
FIG. 6 illustrates exemplary embodiments of various hydrogenated isoprene dimers.
Figure 6:
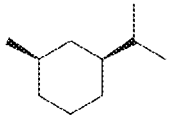
Figure 6:
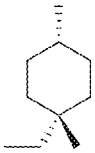
Figure 6:
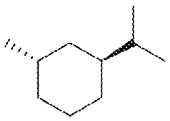
Figure 6:
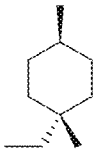
Figure 6:
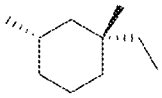
Figure 6:
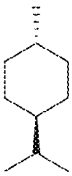
Figure 6:
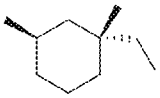

Referring now to FIG. 6, exemplary embodiments of various hydrogenated isoprene dimers (HIDs) is illustrated. In one or more embodiment, HIDs may include (1s,4s)-1-isopropyl-4-methylcyclohexane, (1s,4s)-1-ethyl-1,4-dimethylcyclohexane, (1S,3R)-1-isopropyl-3-methylcyclohexane, (1S,3S)-1-isopropyl-3-methylcyclohexane, (1r,4r)-1-ethyl-1,4-dimethylcyclohexane, (1r,4r)-1-isopropyl-4-methylcyclohexane, (1R,3S)-1-ethyl-1,3-dimethylcyclohexane, (1R,3R)-1-ethyl-1,3-dimethylcyclohexane.

Examples

The following examples are intended to be illustrative of the disclosure only and are not intended to limit the scope or underlying principles in any way.

Experimental testing was conducted in connection with a composition described herein and various other aviation fuel compositions. Additional details regarding this testing are provided in "Extended Fuel Properties of Sustainable Aviation Fuel Blends Derived from Linalool and Isoprene" by C. J. Walking et al., *Fuel,* 356 (2024) 129554, the contents of which are incorporated herein by reference in their entirety. Materials used in this testing were obtained as follows. RJ-4 was obtained from the Naval Air Warfare Center, Weapons Division (NAWCWD) and distilled prior to use. The fuel characterization of this batch of RJ-4 can be found in Woodroffe J-D, Harvey B G. "High-performance, Biobased, Jet Fuel Blends Containing Hydrogenated Monoterpenes and Synthetic Paraffinic Kerosenes." *Energy Fuels* 2020; 34:5929-37. Jet-A was obtained from the fuel depot at NAWCWD and used as received. HEFA-Jet was supplied by the Air Force Research Laboratory (AFRL) and used as received. p-Menthane was synthesized from limonene as described by Woodroffe J-D, Harvey B G. "High-performance, Biobased, Jet Fuel Blends Containing Hydrogenated Monoterpenes and Synthetic Paraffinic Kerosenes." *Energy Fuels* 2020; 34:5929-37. DMCO and HID were synthesized from commercial isoprene as described by Rosenkoetter K E, Kennedy C R, Chirik P J, Harvey B G. in "[4+4]-Cycloaddition of Isoprene for the Production of High-performance Bio-based Jet Fuel." *Green Chem* 2019; 21:5616-23 and by Woodroffe J-D, Harvey B G. in "Thermal Cyclodimerization of Isoprene for the Production of High-performance Sustainable Aviation Fuel." *Energy Adv* 2022; 1:338-43.

Isobutylene trimers were prepared as follows. A reactor was assembled by plugging the end of an L-shaped Pyrex column with glass wool and filling the column with 63.81 g of Amberlyst-15 catalyst. The column length was 30 cm with a radius of 0.9 cm, giving a total volume of 76.34 $cm^3$. A gas inlet was attached to the top of the column, which was then connected to an isobutylene tank and nitrogen source with Tygon™ tubing. The column was wrapped in heat tape, followed by glass wool and aluminum foil. The internal/wall temperature of the column was monitored with a thermometer. The end of the column was attached to a 2-liter, 3-neck round bottom flask, which was submerged in an ice bath. A condenser was attached to another neck, the outlet of which was connected to a bubbler filled with mineral oil. The column was heated to 95° C. and nitrogen was allowed to flow over the catalyst for an hour. Afterwards, isobutylene was introduced into the column. The catalyst bed temperature increased from 95° C. to 105° C. and the heat input was then reduced to maintain a steady 95° C. temperature. Shortly after the addition of isobutylene, liquid began to condense in the round bottom flask. A steady flow rate was maintained for seven hours, resulting in the collection of 387 g of product, which consisted of a mixture of isobutylene dimers, trimers and tetramers. GC-MS analysis revealed the following product distribution: dimers (30.4%), trimers (64.4%), and tetramers (5.1%). The resulting products were fractionally distilled under reduced pressure (0.5 mm Hg). Fraction 1 was distilled at an ambient temperature and contained 114.63 g of dimers and trimers. Fraction 2 was distilled at 50° C. and contained 183.27 g of trimer with traces of dimer while the pot residue contained a mixture of trimers and tetramer. Fraction 1: 1H NMR (400 MHZ, CDCl3) δ=5.16 (pent., J=1.2 Hz), 4.82 (sext., J=1.2 Hz), 4.63-4.60 (m), 1.92 (s), 1.77 (s), 1.70 (s), 1.67-1.64 (m), 1.07 (s), 0.93-0.90 (m). Fraction 2: 1H NMR (400 MHZ, CDCl3) δ=5.09 (s), 4.78 (s), 1.93 (s), 1.82 (s), 1.76-1.73 (m), 1.52 (s), 1.10-1.08 (m), 0.88-0.86 (m).

All blends were prepared on a volume basis according to Table 2 and thoroughly mixed prior to testing.

TABLE 2

The composition of fuel blends studied in this example.

| Fuel | Composition | Comments |
|---|---|---|
| L-Jet | 30% RJ-4, 20% HIBT, 25% p-menthane, 25% 2,6-DMO | 100% SAF derived from linalool |
| F1 | 30% DMCO, 70% HEFA-Jet | 100% SAF blend with DMCO |
| F2 | 30% HID, 70% HEFA-Jet | 100% SAF blend with HID |
| F3 | 10% DMCO, 90% Jet-A | DMCO blend with Jet-A |
| F4 | 10% HID, 90% Jet-A | HID blend with Jet-A |

TABLE 2-continued

The composition of fuel blends studied in this example.

| Fuel | Composition | Comments |
|---|---|---|
| F5 | 50% L-Jet, 50% HEFA-Jet | 100% SAF L-Jet blend |
| F6 | 50% L-Jet, 50% Jet-A | L-Jet blend with Jet-A |

The density, kinematic viscosity, net heat of combustion, and flashpoint of fuels were obtained as previously described by Keller C L, Walkling C J, Zhang D D, Baldwin L C, Austin J S, Harvey B G in "Designer Biosynthetic Jet Fuels Derived from Isoprene and α-olefins. *ACS Sust Chem Engin* 2023; 11:4030-9. Other fuel properties including corrosion, simulated distillation, electrical conductivity, lubricity, smoke point, residual gum, acidity, derived cetane number, and jet fuel thermal oxidation stability (JFTOT) were measured by the Southwest Research Institute utilizing ASTM D130, D2887, D2624, D5001, D1322, D381, D3242, D6890, and D3241, respectively.

Conventional petroleum-based jet fuels are composed of hundreds of different compounds including normal alkanes, branched alkanes, cycloalkanes, and aromatic compounds. To generate a surrogate jet fuel from linalool that would mimic the properties of these complex mixtures, it was of interest to combine multiple fuel synthesis pathways to diversify the final fuel blend. Previous work has demonstrated the conversion of linalool to RJ-4, a mixture of tetrahydrodimethyldicyclopentadienes (Meylemans H A, Quintana R L, Goldsmith B R, Harvey B G "Solvent-free Conversion of Linalool to Methylcyclopentadiene Dimers: A Route to Renewable High-density Fuels" *ChemSusChem* 2011; 4:465-9), as well as the cycloalkane, p-menthane, and the branched alkane 2,6-dimethyloctane (Keller C L, Doppalapudi K R, Woodroffe J-D, Harvey B G. "Solvent-free Dehydration, Cyclization, and Hydrogenation of Linalool with a Dual Heterogeneous Catalyst System to Generate a High-performance Sustainable Aviation Fuel. *Commun Chem* 2022; 5:113). In addition, the ring-closing metathesis reaction that generates the precursor to RJ-4 also generates isobutylene as a side-product as illustrated in the following Scheme 1.

Scheme 1. Synthesis of jet fuel blendstocks from biosynthetic linalool.

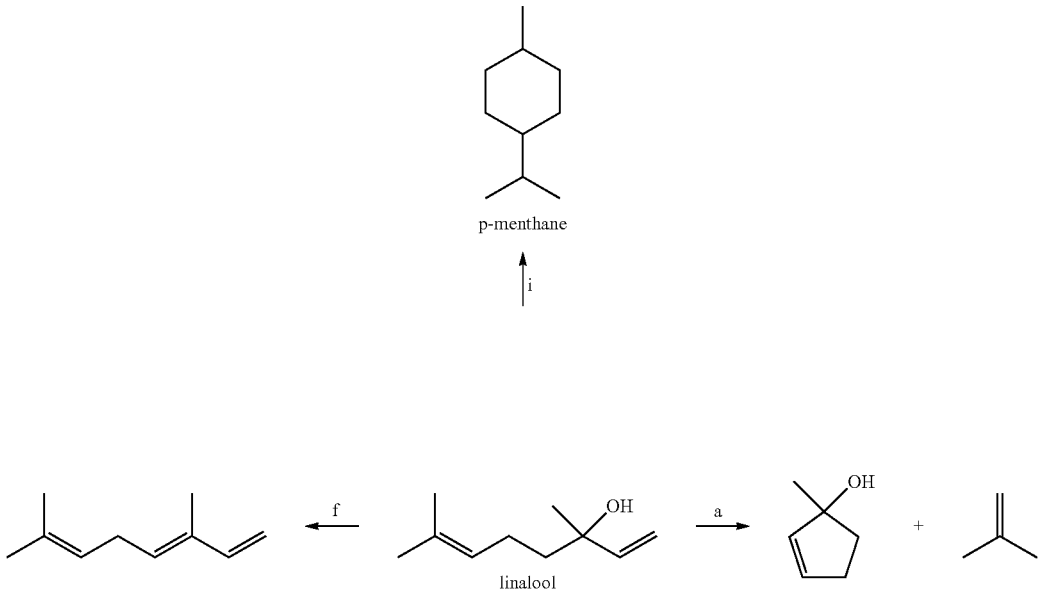

-continued

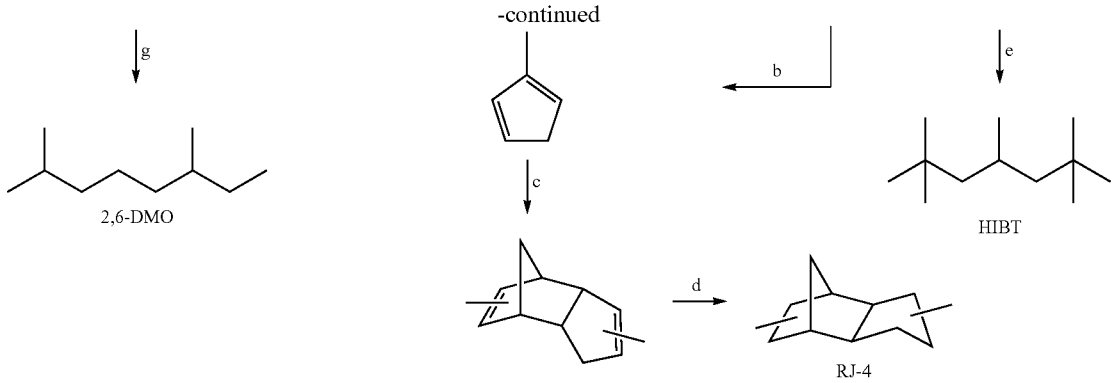

(a) [Ru]-catalyzed ring closing metathesis.
(b) Dehydration.
(c) Diels-Alder cycloaddition.
(d) Lewis acid catalyzed isomerization to the exo-isomers.
(e) Catalytic trimerization and hydrogenation.
(f) Dehydration.
(g) Hydrogenation.
(i) Dehydration, cyclization, and hydrogenation.

Isobutylene can be selectively oligomerized (Yoon J W, Chang J-S, Lee H-D, Kim T-J, Jhung S H. "Trimerization of Isobutene Over a Zeolite Beta Catalyst. *J Catal* 2007; 245:253-6, Alc'antra R, Alc'antra E, Canoira L, Franco M J, Herrera M, Navarro A. "Trimerization of Isobutene over Amberlyst-15 Catalyst" *React Funct Polym* 2000; 45:19-27 and Yoon J W, Jhung S H, Kim T-J, Lee H-D, Jang N H, Chang J-S. "Trimerization of Isobutene Over Solid Acid Catalysts Under Wide Reaction Conditions." *Bull Korean Chem Soc* 2007; 28:2075-8.) and hydrogenated to generate jet fuel range hydrocarbons hydrogenated isobutylene trimers (HIBT): primarily trimers, $C_{12}H_{26}$). Fuels produced directly from isobutylene would be expected to be similar to commercial sustainable aviation fuel (SAF) produced from isobutanol (Dedov A G, Karavaev A A, Loktey A S, Osipov A K. "Bioisobutanol as a Promising Feedstock for Production of "Green" Hydrocarbons and Petrochemicals (a review)" *Petrol Chem* 2021; 61:1139-57.). To explore blends containing HIBT, isobutylene was oligomerized at 95-100° C. in a packed column using Amberlyst-15 as the catalyst. This resulted in the production of primarily trimers (64.4%) along with dimers (30.4%) and small amounts (5.1%) of tetramers (shown in FIG. 1 which illustrates gas chromatograms showing the crude isobutylene oligomer product distribution (top, green), purified isobutylene trimer fraction (middle, blue) and hydrogenated isobutylene trimers (HIBT, bottom, orange). Although the dimers have applications as components of gasoline and avgas (Goortani B M, Gaurav A, Deshpande A, Ng F T T, Rempel G L. "Production of Isooctane From Isobutene: Energy Integration and Carbon Dioxide Abatement via Catalytic Distillation" *Ind Eng Chem Res* 2015; 54:3570-81 and Al-Kinany M C, Al-Drees S A, Al-Megren H A, Alshihri S M, Alghilan E A, Al-Shehri F A, et al. *Appl Polym Res* 2019; 9:35-45), their flashpoint is too low to meet the specifications for conventional jet fuel. Therefore, the trimer fraction was purified via fractional distillation and hydrogenated to obtain a saturated product (HIBT). 1H and 13 C NMR spectroscopy revealed that the saturated trimer was primarily 2,2,4,6,6-pentamethylheptane according to the following scheme 2.

Scheme 2. Synthesis of HIBT from isobutylene.

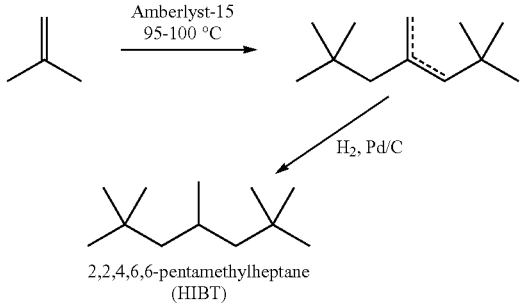

Prior to preparing the linalool-based jet fuel, the basic fuel properties of the hydrogenated isobutylene trimer were measured. These data along with fuel properties for all of the pure fuel components used in this study can be found in Table 3.

TABLE 3

Basic fuel properties of fuels and blendstocks discussed in this example.

| Fuel/Blendstock | ρ (g mL$^{-1}$) | NHOC (MJ kg$^{-1}$) | NHOC (MJ L$^{-1}$) | η (−20 °C, mm$^2$ s$^{-1}$) | η (−40 °C, mm$^2$ s$^{-1}$) |
|---|---|---|---|---|---|
| RJ-4[7] | 0.925 | 42.21 | 39.03 | 18.31 | 49.86 |
| HIBT[a] | 0.750 | 43.99 | 32.99 | 3.96 | 7.08 |
| p-menthane[7] | 0.804 | 43.20 | 34.72 | 2.98 | 5.19 |
| 2,6-DMO[7] | 0.733 | 43.98 | 32.26 | 2.27 | 3.83 |
| DMCO[38] | 0.827 | 43.82 | 36.22 | 4.17 | 7.95 |

TABLE 3-continued

Basic fuel properties of fuels and blendstocks discussed in this example.

| Fuel/Blendstock | ρ (g mL$^{-1}$) | NHOC (MJ kg$^{-1}$) | NHOC (MJ L$^{-1}$) | η (−20 °C, mm$^2$ s$^{-1}$) | η (−40 °C, mm$^2$ s$^{-1}$) |
|---|---|---|---|---|---|
| HID[39] | 0.806 | 43.34 | 34.94 | 3.10 | 5.45 |
| HEFA-Jet[7] | 0.762 | 43.73 | 33.30 | 5.65 | 12.77 |
| Jet-A[b] | 0.807 | 43.1 | 34.8 | 4.17 | 8.25 |

[a]HIBT fuel properties were measured in this work.

[b]The density and viscosity values listed for Jet-A are for a specific batch of fuel tested in this work. The gravimetric and volumetric NHOC values are typical values for Jet-A.

The blendstocks in Table 3 can be grouped into three different categories: acyclic branched hydrocarbons (HIBT and 2,6-DMO), monocyclic hydrocarbons (p-menthane, DMCO, and HID), and tricyclic hydrocarbons (RJ-4). The acyclic hydrocarbons offer higher gravimetric heats of combustion and lower viscosities, while RJ-4 offers a much higher density and volumetric net heat of combustion at the expense of unacceptably high viscosity at low temperatures. The monocyclic hydrocarbons offer properties intermediate between the acyclic hydrocarbons and RJ-4.

After studying the pure compounds, blends derived from linalool were formulated. Starting from the known conversions of linalool to RJ-4 and isobutylene (Meylemans H A, Quintana R L, Goldsmith B R, Harvey B G. "Solvent-free Conversion of Linalool to Methylcyclopentadiene Dimers: A Route to Renewable High-density Fuels". *ChemSusChem* 2011; 4:465-9.) along with dehydration/hydrogenation of linalool to generate 2,6-DMO (Wright M E, Quintana R L, Harvey B G. "Acyclic Monoterpenes as Biofuels Based on Linalool and Method for Making the Same U.S. Pat. No. 9,266,798), three different fuel blends comprising mixtures of RJ-4, HIBT, and 2,6-DMO were screened. The ratio of HIBT: 2,6-DMO was kept constant, while the amount of RJ-4 increased from 20 to 40 vol %. As expected, increasing the amount of RJ-4 increased the density, viscosity and volumetric heat of combustion with a concomitant decrease in the gravimetric heat of combustion. In all cases, these fuel blends met the basic requirements (density, NHOC, viscosity) for Jet-A (Table 4).

-continued

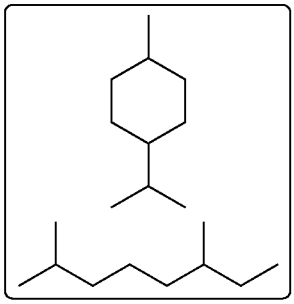

Amberlyst-15 catalyzed the dehydration of linalool to a mixture of acyclic and cyclic terpenes while the Pd/C catalyzed the hydrogenation of the intermediate terpenes to form p-menthane and 2,6-DMO in a ratio of 65:35. This advance allowed for a diversification of the fuel mixtures described in Table 4. The moderate density, low viscosity, and intermediate gravimetric NHOC of p-menthane (Woodroffe J-D, Harvey B G. "High-performance, Biobased, Jet Fuel Blends Containing Hydrogenated Monoterpenes and Synthetic Paraffinic Kerosenes" Energy Fuels 2020; 34:5929-37) made it an ideal blendstock to reduce the amount of HIBT in the mixture to a level consistent with the amount of methylcyclopentadiene and isobutylene generated from ring closing metathesis. On this basis a blend composed of 25% p-menthane, 25% 2,6-DMO,

TABLE 4

Basic fuel properties of RJ-4 blends with HIBT and 2,6-DMO.

| Fuel | NHOC (MJ kg$^{-1}$) | NHOC (MJ/L) | ρ (15 °C, g mL$^{-1}$) | η (−20 °C mm$^2$ s$^{-1}$) | η (−40 °C, mm$^2$ s$^{-1}$) |
|---|---|---|---|---|---|
| Jet-A | >42.80 | >33.17 | >0.775 | <8.0 | <12.0 |
| 30:30:40 (HIBT:DMO:RJ-4) | 43.17 | 35.26 | 0.817 | 5.40 | 11.01 |
| 35:35:30 (HIBT:DMO:RJ-4) | 43.35 | 34.61 | 0.798 | 4.55 | 8.89 |
| 40:40:20 (HIBT:DMO:RJ-4) | 43.55 | 33.99 | 0.781 | 3.90 | 7.32 |
| L-Jet | 43.17 | 35.14 | 0.814 | 4.48 | 8.77 |

A high-throughput approach for the conversion of linalool to p-menthane and 2,6-DMO through a single-step reaction with a dual catalyst composed of Amberlyst-15 and Pd/C under a hydrogen atmosphere has been demonstrated in accordance with the following scheme 3.

Scheme 3. Conversion of linalool to p-methane and 2,6-dimethyloctane.

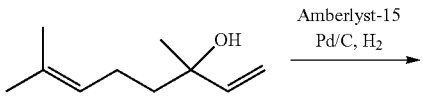

30% RJ-4 and 20% HIBT was prepared (see FIG. 2 which illustrates a comparison of the molecular distribution of L-Jet (top, blue) and HEFA-Jet (bottom, red) and compared to the original HIBT: DMO: RJ-4 blends (Table 4). The new blend, named L-Jet, exhibited density, low-temperature viscosity, and heat of combustion values in line with conventional jet fuel, while limiting the amount of highly branched (HIBT) and multicyclic hydrocarbons (RJ-4). These classes of hydrocarbons, particularly those containing five-membered rings, are known to decrease smoke point and increase the formation of soot. Therefore, reducing the concentration of HIBT and RJ-4 would be expected to improve the combustion properties of the jet fuel mixture.

To further evaluate the suitability of L-Jet as a standalone fuel, extended fuel properties were measured including flash point, corrosion, smoke point, conductivity, simulated distillation, existent gum, lubricity, thermal stability, acidity, and derived cetane number. In addition to L-Jet, four different fuel blends containing cyclic molecules (DMCO and HID) derived from isoprene (Rosenkoetter K E, Kennedy C R, Chirik P J, Harvey B G. "[4+4]-Cycloaddition of Isoprene for the Production of High-performance Bio-based Jet Fuel" Green Chem 2019; 21:5616-23 and Woodroffe J-D, Harvey B G. "Thermal Cyclodimerization of Isoprene for the Production of High-Performance Sustainable Aviation Fuel" Energy Adv 2022; 1:338-43) were screened. The isoprene-based fuel blends included a 30:70 (by volume) mixture of DMCO and HEFA-Jet (F1), a 30:70 mixture of HID and HEFA-Jet (F2), a 10:90 mixture of DMCO with Jet-A (F3), and a 10:90 mixture of HID with Jet-A (F4). The 30:70 mixtures were screened as potential 100% SAF blends, while the 10:90 mixtures were evaluated as near-term blends with the potential for rapid certification. Either HEFA-Jet or Jet-A was used as the bulk component in these blends to allow for surrogate jet fuels with a broad range of molecular weights and boiling points to mitigate the use of a single component (DMCO) or isomeric mixture of C10H2O cyclic hydrocarbons (HID). A comparison of these fuels and the requirements established under ASTM D7566 can be found in Table 5.

TABLE 5

Extended fuel properties for L-Jet and F1-F4.

| Property | L-Jet | 30:70 DMCO:HEFA (F1) | 30:70 HID:HEFA (F2) | 10:90 DMCO:Jet-A (F3) | 10:90 HID:Jet-A (F4) | ASTM D7566 |
|---|---|---|---|---|---|---|
| Density (g/mL) | 0.814 | 0.780 | 0.774 | 0.809 | 0.807 | >0.725 |
| η(−20 °C) [$mm^2s^{-1}$] | 4.48 | 5.03 | 4.57 | 4.12 | 4.02 | <8.0 |
| η(−40 °C) [$mm^2s^{-1}$] | 8.77 | 10.54 | 9.20 | 8.08 | 7.82 | <12 |
| NHOC (MJ $kg^{-1}$) | 43.17 | 43.76 | 43.65 | 43.17 | 43.12 | >42.8 |
| Flash Point (°C) | 45 | 51 | 43 | 49 | 49 | >38 |
| Corrosion (No.) | 1A | 1A | 1A | 1A | 1A | 1 |
| Smoke Point (mm) | 25.7 | 49.4 | 48.5 | 22.6 | 22.6 | >25 |
| Conductivity (pS/m) | 7* | 4* | 10* | 120 | 111 | 50-600 (Jet-A) |
| Simulated Dist. (T50-T10) | 13 | 29 | 28 | 39 | 40 | >15 |
| Simulated Dist. (T90-T10) | 96 | 104 | 108 | 107 | 108 | >40 |
| Exist. Gum (mg/100 mL) | 6 | 4 | 1 | 1 | 2 | <7 |
| Lubricity (mm) | 0.732 | 0.734 | 0.469 | 0.552 | 0.497 | <0.85 |
| Thermal Stability | Code: 1; pressure drop (0 mmHg); deposits (6.390 nm) | Code: 1; pressure drop (0 mmHg); deposits (7.050 nm) | Code: 1; pressure drop (0 mmHg); deposits (9.720 nm) | Code: 1; pressure drop (0 mmHg); deposits (32.030 nm) | Code: 1; pressure drop (0 mmHg); deposits (47.180 nm) | Code (<3); pressure drop (<25 mmHg); deposits (<85 nm) |
| Acidity (mg KOH/g) | 0.002 | 0.001 | — | 0.016 | — | <0.10 |
| Derived Cetane No. | 30 | 44 | 51.5 | 42.1 | 43.3 | >30 |

*Easily remediated through the use of additives.

All of the blends, with the exception of F2, met the density requirement set by ASTM D7566. However, the density of F2 is only 0.001 g/mL lower than the requirement and slightly increasing the concentration of HID would alleviate this issue. This result demonstrates the utility of SAF blendstocks containing cycloalkanes (Muldoon J A, Harvey B G. "Bio-based Cycloalkanes: The Missing Link to High-performance Sustainable Jet Fuels." *ChemSusChem* 2020; 13:5777-807), which have significantly higher densities compared to straight or branched chain acyclic alkanes that typically make up the bulk of bio-based synthetic paraffinic kerosenes (Muldoon J A, Harvey B G. "Bio-based Cycloalkanes: The Missing Link to High-performance Sustainable Jet Fuels." *ChemSusChem* 2020; 13:5777-807). For example, the 30:70 DMCO: HEFA-Jet blend (F1) exhibits a 2.4% higher density compared to pure HEFA-Jet. All of the fuel blends meet the Jet-A and ASTM D7566 kinematic viscosity requirements at both −20 and −40° C. A graphical comparison of the viscosities of all the fuels from 20 to −40° C. can be found in FIG. 3 which illustrates kinematic viscosities from −40 to 20° C. for fuel blends studied. Values are accurate to within 0.445% at the 95% confidence level. L-Jet is a mixture of $C_{10}$ and $C_{12}$ hydrocarbons, while DMCO is a pure $C_{10}$ cycloalkane and HID is a mixture of $C_{10}$ cycloalkanes. All of the bio-based blendstocks exhibit excellent low temperature viscosity (Table 3). The addition of DMCO to HEFA-Jet resulted in an 11% and 17% lower kinematic viscosity at −20 and −40° C., respectively. The impact for the HID blends was even more significant with reductions of 19 and 28%, respectively. For both DMCO and HID, the addition of the cycloalkane blendstock to HEFA- Jet resulted in a mixture that met the kinematic viscosity requirements specified by ASTM D7566 at −40° C. (<12.0 $mm^2$ s·l). The impact of DMCO and HID on the density and viscosity of Jet-A was more subtle due to the similarities between the values for the blendstocks and the main components.

L-Jet exhibited a gravimetric NHOC comparable to a typical sample of Jet-A (43.1 MJ kg-1). 2,6-DMO and HIBT (both saturated branched chain hydrocarbons) offered NHOCs higher than Jet-A, while the RJ-4 component contributed a lower NHOC due to its lower hydrogen con-tent. In combination with p-menthane, which has a slightly higher NHOC compared to Jet-A, the net effect was a modest increase in NHOC compared to Jet-A (0.8% higher than the lower limit). F2 and F3 had NHOCs that were 2.2 and 2.1% higher, respectively, than the lower limit for Jet-A. This improvement in gravimetric energy density can be attributed to the lack of aromatic compounds in F2 and F3 and overall higher hydrogen content.

Flash point is a critical jet fuel property that must be met to ensure safe operation. The Jet-A lower limit for flashpoint is 38° C. All of the fuels met this requirement with flashpoints ranging from 43 to 51° C. F2 and L-Jet had the lowest flashpoints, suggesting that p-menthane and related structures in F2 are responsible for these lower values. All of the fuels, including the Jet-A blends, exhibited the highest level of corrosion performance based on the ASTM standard method involving copper strip corrosion testing. Existent gum is a measurement of residual oligomeric or polymeric material in the fuel that may form due to the presence of unsaturated molecules (e.g. alkenes) or molecules with heteroatoms. All of the fuel blends met the existent gum specification demonstrating the purity and stability of the biosynthetic fuel components.

Jet fuels must have good thermal stability at elevated temperature (e.g. 260° C.) to prevent coking in the combustor and reduce long-term maintenance costs. Thermal stability is measured using a jet fuel thermal oxidation tester (JFTOT). The thermal stability is reported as a code based on the color of a metal component exposed to the fuel at elevated temperature. In addition, the test measures a pressure drop across a filter that catches decomposition products as well as the amount of material deposited on the test strip. ASTM D7566 requires a code <3, a pressure drop <25 mmHg, and deposits <85 nm. All of the fuels tested were code 1, representing the highest level of thermal stability. In addition, no pressure drop was observed for any of the fuels. The deposition level was extraordinarily low for all of the 100% bio-based blends, ranging from 6.39 to 9.72 nm. In contrast, the two blends prepared with Jet-A exhibited intermediate deposition levels of 32.03 and 47.18 nm for F3 and F4, respectively. This difference is likely attributable to the lack of aromatic compounds in the 100% bio-based fuel blends.

Smoke point is a measure of combustion quality and the amount of unburned hydrocarbons and particulates that would be produced during the combustion process. The lower limit for Jet-A is 25 mm or 18 mm coupled with a naphthalene concentration below 3%. The two HEFA-Jet blends, which contain no aromatic compounds, exhibited outstanding smoke points of 49.4 and 48.5 mm for F1 and F2, respectively. This result showed no significant difference between the soot forming propensity of DMCO compared to HID when blended with a wide-cut synthetic paraffinic kerosene (SPK). L-Jet exhibited a smoke point of 25.7, meeting the specification for Jet-A. The significantly lower smoke point of L-Jet is likely due to the presence of RJ-4, which is composed of tricyclic hydrocarbons, and HIBT, which is primarily composed of the highly branched 2,2,4,6,6-pentamethylheptane. Recent studies have shown that cycloalkanes containing 5-membered rings have a high sooting propensity due to the formation of cyclopentadienyl and allyl radicals, which are efficient aromatic precursors (Xu L, Yan F, Wang Y. "A Comparative Study of the Sooting Tendencies of Various C5-C8 Alkanes, Alkenes and Cycloalkanes in Counterflow Diffusion Flames. *Appl Energy Comb Sci* 2020;1-4:10007). Therefore, it would be expected for RJ-4 to negatively impact the smoke point. Further, the yield sooting index of 2,2,4,6,6-pentamethylheptane has been measured by Pfefferle and found to have a value similar to benzene (Das D D, St. John P C, McEnally C S, Kim S, Pfefferle L D. "Measuring and Predicting Sooting Tendencies of Oxygenates, Alkanes, Alkenes, Cycloalkanes, and Aromatics on a Unified Scale." *Combust Flame* 2018; 190:349-64.). Despite this, L-Jet still met the ASTM requirements and exhibited a higher smoke point compared to the Jet-A blends tested. The two Jet-A blends exhibited relatively low smoke points of 22.6 mm, which still met the specification due to a low concentration of naphthalenes. No difference was observed based on the SAF blendstock (either DMCO or HID).

The derived cetane numbers of the fuels were measured by ignition quality testing (IQT), which measures the ignition delay of the fuel under compression ignition conditions. Although this type of test is typically used to evaluate diesel fuels, ASTM D7566 includes a requirement for DCN, which can also be used as a proxy for combustion efficiency. Typically, normal alkanes have the highest cetane numbers while the presence of significant chain branching, particularly the presence of quaternary carbons, greatly reduces DCN (Harvey B G, Merriman W W, Koontz T A. "High Density Renewable Diesel and Jet Fuels Prepared from Multicyclic Sesquiterpanes and a 1-hexene Derived Synthetic Paraffinic Perosene. *Energy Fuels* 2015; 29:2431-6 and Yanowitz J, Ratcliff M A, McCormick R L, Taylor J D, Murphy M J. "Compedium of Experimental Cetane Number Data. Golden, CO: *National Renewable Energy Laboratory* (NREL); 2017; NREL/TP-5400-67585). Both F1 and F2 had excellent cetane numbers of 44 and 51.5, respectively, significantly higher than that required by ASTM D7566 (30). DMCO is known to have a low cetane number of around 18, but blending it with HEFA easily mitigated this issue. The 7.5-point higher DCN of F2 is a result of the higher DCN of the cycloalkanes that compose the HID mixture. As expected, F3 and F4 had similar DCNs >40, which were consistent with typical values for the bulk component (Jet-A). In contrast, L-Jet barely met the DCN requirement. The modest DCN of L-Jet is attributable to the low DCNs of RJ-4 (24) (Harvey B G, Merriman W W, Koontz T A. "High Density Renewable Diesel and Jet Fuels Prepared from Multicyclic Sesquiterpanes and a 1-hexene Derived Synthetic Paraffinic Kerosene." *Energy Fuels* 2015; 29:2431-6.) and HIBT (17) (Won S H, Haas F M, Tekawade A, Kosiba G, Oehlschlaeger M A, Dooley S, et al. "Combustion Characteristics of C5 Iso-alkane Oligomers: Experimental Characterization of Iso-dodecane as a Jet Fuel Surrogate Somponent". *Combust Flame* 2016; 165:137-43.). The DCN of p-menthane is moderate (29) (Harvey B G, Merriman W W, Koontz T A. "High Density Renewable Diesel and Jet Fuels Prepared from Multicyclic Sesquiterpanes and a 1-hexene Derived Synthetic Paraffinic Kerosene." *Energy Fuels* 2015; 29:2431-6), while that for 2,6-DMO is 52 (Yanowitz J, Ratcliff M A, McCormick R L, Taylor J D, Murphy M J. "Compedium of Experimental Cetane Number Data. Golden, CO: *National Renewable Energy Laboratory* (NREL); 2017; NREL/TP-5400-67585), twelve units higher than the lower limit for diesel fuel. Interestingly, using the DCNs of the pure components and weighted averages based on volume, a DCN value of 31 was calculated, in line with the measured value.

Distillation of a fuel mixture provides information regarding the molecular composition of the fuel and how the distribution of molecules affects the boiling point. To understand the differences between the fuels studied in this work, simulated distillation curves were constructed based on gas chromatography experiments (see FIG. 4 which illustrates simulated distillation curves for various fuel mixtures). ASTM D7566 requires the difference between the temperature at which 10% of the fuel and 50% of the fuel distills to be >15° C. For F1-F4, which contain broad hydrocarbon distributions as a result of the use of HEFA-Jet or Jet-A as the primary component, T50-T10 for these fuels ranged from 28 to 40° C., well within ASTM specifications. Interestingly, F1, which contains 30% DMCO, exhibited a plateau at ca. 180° C. from 13 to 44% distilled. In contrast, F2, which contains 30% HID, did not exhibit a plateau and had a distillation profile similar to F4-F6. This difference may be attributable to the more complicated distribution of isomers in HID (Woodroffe J-D, Harvey B G. "Thermal Cyclodimerization of Isoprene for the Production of High-performance Sustainable Aviation Fuel" *Energy Adv* 2022; 1:338-43). As expected, L-Jet, which has a relatively narrow distribution ($C_{10}$ and $C_{12}$) of hydrocarbons, had a T50-T10 difference of only 13° C., slightly lower than the requirement. In addition, several plateaus were observed due to the presence of discrete molecules with well-defined boiling points (e.g. 2,6-DMO, p-menthane, and 2,2,4,6,6-pentamethylheptane) as well as closely related RJ-4 isomers. With an eye toward developing L-Jet fuel blends that met the T50-T10 boiling point range requirements of ASTM D7566, two additional fuel blends, F5 and F6, were prepared by combining L-Jet with an equal volume of HEFA-Jet or Jet-A, respectively. F5 and F6 exhibited T50-T10 values of 41 and 32° C., respectively, demonstrating that any issues with boiling point range can be easily overcome by blending with a wide boiling point SPK or conventional jet fuel. The T90-T10 values for all of the fuels were well above the minimum difference required by ASTM D7566 (40° C.). F1-F4 had T90-T10 values ranging from 104 to 108° C., while L-Jet had a value of 56° C.

Unless specific arrangements described herein are mutually exclusive with one another, the various implementations described herein can be combined to enhance system functionality or to produce complementary functions. Likewise, aspects of the implementations may be implemented in standalone arrangements. Thus, the above description has been given by way of example only and modification in detail may be made within the scope of the present invention.

What is claimed is:

1. A composition, comprising a mixture of at least one n-alkane and at least one iso-alkane, one or more compounds according to formula (I)

(I)

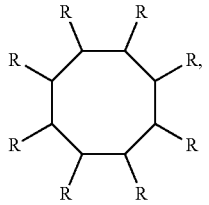

wherein each R independently represents a hydrogen atom or an alkyl group;

wherein a density of the composition is greater than 0.775 g/mL, and a derived cetane number of the composition is greater than 30; and wherein the composition comprises between 50% to 95% by weight of the one or more compounds according to formula (I) and between 5% to 50% by weight of the mixture of the at least one n-alkane and the at least one iso-alkane.

2. The composition of claim 1, wherein the one or more compounds according to formula (I) include one or more of a following:

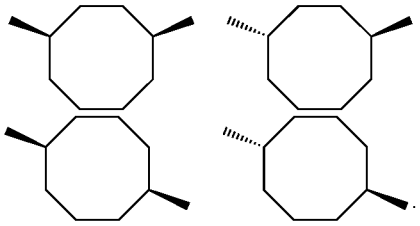

3. The composition of claim 1, further comprising one or more compounds having one of following structures:

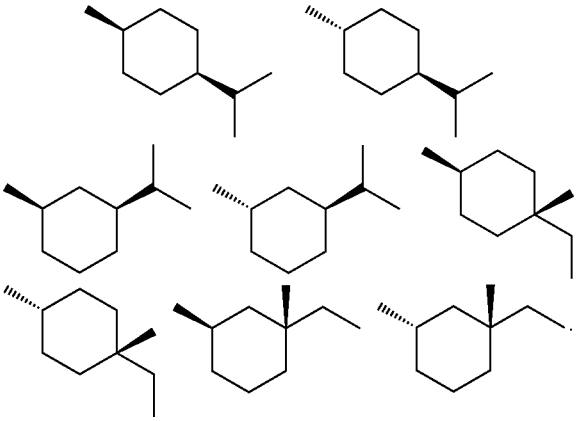

4. The composition of claim 1, wherein the composition is free of aromatic compounds.

5. The composition of claim 1, wherein the composition is free of petroleum-based compounds.

6. The composition of claim 1, wherein the composition comprises one or more petroleum-based compounds.

7. The composition of claim 1, wherein the composition is mixed with one or more fuel compositions selected from the group consisting of synthetic paraffinic kerosene (SPK), Jet-A fuel, HEFA, HEFA-Jet and L-Jet.

8. The composition of claim 1, wherein the at least one n-alkane is an n-decane and the at least one iso-alkane is an iso-decane selected from the group consisting of 2-methyl nonane, 3-methyl nonane, 4-methyl nonane, 2,2-dimethyl octane, 3,3-dimethyl octane, 4,4-dimethyl octane, 2,3-dimethyl octane, 2,4-dimethyl octane, 2,5-dimethyl octane, 2,6-dimethyl octane, 2,7-dimethyl octane, 3,4-dimethyl octane, 3,5-dimethyl octane, 3,6-dimethyl octane, 2,2,3-trimethyl heptane, 2,2,4-trimethyl heptane, 2,2,5-trimethyl heptane, 2,2,6-trimethyl heptane, 2,3,3-trimethyl heptane, 2,3,4-trimethyl heptane, 2,3,5-trimethyl heptane, 2,3,6-trimethyl heptane, 3,3,4-trimethyl heptane, 2,2,3,3-tetramethyl hexane, 2,2,4,4-tetramethyl hexane, 2,2,5,5-tetramethyl hexane, 2,3,3,4-tetramethyl hexane, 2,3,3,5-tetramethyl hexane, 2,3,4,5-tetramethyl hexane, 2,2,3,3,4-pentamethyl pentane, 2,2,3,4,4-pentamethyl pentane and mixtures thereof.

9. The composition of claim 1, wherein the density is greater than 0.8 g/mL.

10. The composition of claim 9, wherein the derived cetane number is greater than 40.

11. A method, comprising blending a mixture of at least one n-alkane and at least one iso-alkane, with one or more compounds according to formula (I)

(I)

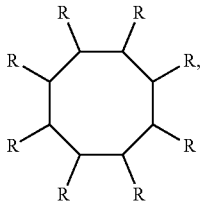

wherein each R independently represents a hydrogen atom or an alkyl group, to provide a composition exhibiting a density greater than 0.775 g/mL and a derived cetane number greater than 30; and wherein the blend comprises between 50% to 95% by weight of the one or more compounds according to formula (I) and between 5% to 50% by weight of the mixture of the at least one n-alkane and the at least one iso-alkane.

12. The method of claim 11, wherein the one or more compounds according to formula (I) include one or more of a following:

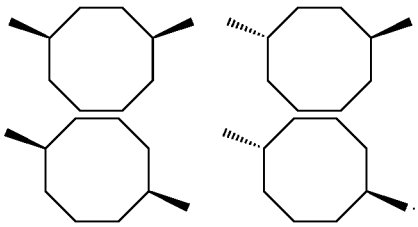

13. The method of claim 11, wherein the blending includes blending the mixture of the at least one n-alkane and the at least one iso-alkane, and the one or more compounds according to formula (I), with one or more compounds having one of following structures:

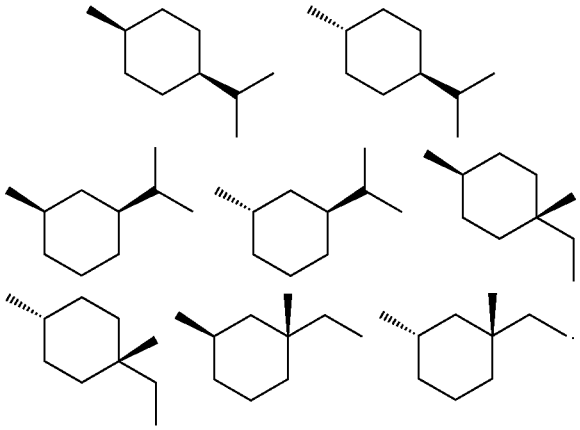

14. The method of claim 11, wherein the composition is free of aromatic compounds.

15. The method of claim 11, wherein the composition is free of petroleum-based compounds.

16. The method of claim 11, further comprising blending the one or more compounds according to formula (I), the at least one n-alkane and the at least one iso-alkane with petroleum-based compounds.

17. The method of claim 11, further comprising blending the one or more compounds according to formula (I), the at least one n-alkane and the at least one iso-alkane with one or more fuel compositions selected from the group consisting of synthetic paraffinic kerosene (SPK), Jet-A fuel, HEFA, HEFA-Jet and L-Jet.

18. The method of claim 11, further comprising adjusting an amount of the one or more compounds according to formula (I) blended with the mixture of the at least one n-alkane and the at least one iso-alkane based on the density of at the least one n-alkane, the at least one iso-alkane or the mixture thereof.

19. The method of claim 11, wherein the composition exhibits a density greater than 0.8 g/mL and a derived cetane number greater than 40.

20. The method of claim 11, further comprising mixing 50% to 95% by weight of the one or more compounds according to formula (I) with between 5% to 50% by weight of the mixture of the at least one n-alkane and the at least one iso-alkane.

* * * * *